US007644910B2

(12) United States Patent
Matsumoto

(10) Patent No.: US 7,644,910 B2
(45) Date of Patent: Jan. 12, 2010

(54) METHOD OF GENERATING MICRO GAS BUBBLE IN LIQUID AND GAS BUBBLE GENERATION APPARATUS

(75) Inventor: Tadao Matsumoto, Saitama (JP)

(73) Assignee: Fuki Co., Ltd., Saitama (JP)

( * ) Notice: Subject to any disclaimer, the term of this patent is extended or adjusted under 35 U.S.C. 154(b) by 538 days.

(21) Appl. No.: 11/660,309

(22) PCT Filed: Aug. 17, 2005

(86) PCT No.: PCT/JP2005/014985

§ 371 (c)(1),
(2), (4) Date: Feb. 15, 2007

(87) PCT Pub. No.: WO2006/019107

PCT Pub. Date: Feb. 23, 2006

(65) Prior Publication Data

US 2007/0152357 A1 Jul. 5, 2007

(30) Foreign Application Priority Data

Aug. 18, 2004 (JP) ..... 2004-238195

(51) Int. Cl.
*B01F 3/04* (2006.01)

(52) U.S. Cl. ..... 261/91

(58) Field of Classification Search ..... 261/84, 261/91, 93

See application file for complete search history.

(56) References Cited

U.S. PATENT DOCUMENTS 5,009,816 A 4/1991 Weise et al.

(Continued)

FOREIGN PATENT DOCUMENTS

JP 61-36448 8/1986

(Continued)

OTHER PUBLICATIONS

Masayoshi Takahashi et al., *Effect of Shrinking Microbubble on Gas Hydrate Formation*, The Journal of Physical Chemistry, vol. 107, No. 10, Mar. 13, 2003, pp. 2171-2174.

*Primary Examiner*—Scott Bushey
(74) *Attorney, Agent, or Firm*—Wenderoth, Lind & Ponack, L.L.P.

(57) ABSTRACT

A method and an apparatus for generating gas bubbles, which can generate a large amount of micro gas bubbles having diameters of less than 15 μm, specifically less than 10 μm, in a liquid. The apparatus comprises a tube 2 having a closed end 14 at one end and an open end 15 at the other end, and a rotating bladed wheel 3 installed in the tube 2 and rotating coaxially or substantially coaxially with the tube 2. The rotating bladed wheel 3 has one or more blades 4. The face of each blade 4 is substantially parallel to the axis of a rotating shaft 5 of the rotating bladed wheel 3. Ventilation resistance between the interior of the tube 2 on the side near the closed end 14 and the outside gas is equal to or larger than that of a ventilation port 7 having an inner diameter of 0.36 time an average width d of the blades and a length of 3 mm. At least the open end 15 of the tube 2 and the rotating bladed wheel 3 are immersed in a liquid 20 and the rotating bladed wheel 3 is rotated at a peripheral speed of 5.8 m/sec or higher.

11 Claims, 9 Drawing Sheets

U.S. PATENT DOCUMENTS 5,413,765 A * 5/1995 Smith et al. ..... 422/168
5,527,475 A * 6/1996 Smith et al. ..... 210/787

FOREIGN PATENT DOCUMENTS

JP 5-220364 8/1993
JP 6-91146 4/1994
JP 7-88345 4/1995
JP 2000-447 1/2000
JP 2001-137680 5/2001

* cited by examiner

METHOD OF GENERATING MICRO GAS BUBBLE IN LIQUID AND GAS BUBBLE GENERATION APPARATUS

TECHNICAL FIELD

The present invention relates to a method of generating micro gas bubbles in a liquid and a gas bubble generation apparatus. More specifically, the present invention relates to a method of generating a large amount of micro gas bubbles having diameters of less than 15 μm, and a gas bubble generation apparatus.

BACKGROUND ART

There is known a method of generating a large amount of fine gas bubbles in a liquid in order to efficiently dissolve gas, such as air, in a liquid, such as water. By generating gas bubbles with diameters of 10-50 μm in the liquid, rising speeds of the gas bubbles due to buoyancy are greatly slowed down. Therefore, the gas bubbles remain in the liquid for a longer time and the gas is dissolved in the liquid with higher efficiency.

Patent Document 1 discloses a liquid-gas agitating and mixing apparatus comprising an outer shell member having a linear cylindrical shape, and a drive member having a linear columnar shape, inserted coaxially within the outer shell member and rotated at a high speed, wherein a gap between the outer shell member and the drive member is set to the smallest possible value within a range allowing the liquid to enter the gap when the drive member is rotated at the high speed. More specifically, the liquid and the gas are caused to enter the gap between the outer shell member and the drive member, and they are agitated and mixed with each other due to vigorous vortex flow motions of the liquid, which are generated by the high-speed rotation of the drive member. The liquid containing a large number of fine gas bubbles generated with the agitation and the mixing is powerfully released through an opening at the lower end of the outer shell member, thus enabling a large number of very fine gas bubbles to float in the liquid for a long period.

In the apparatus disclosed in Patent Document 1, the peripheral speed at an outer peripheral surface of the drive member is required to be set to about 12 m/sec, and the drive member has to be rotated at such a high speed. Also, because of the necessity of agitating and mixing the liquid and the gas for a period of not shorter than a certain time, the outer shell member and the drive member must have a length of not shorter than a certain value, and they are required to have high dimensional accuracy to prevent vibration of the drive member rotating at the high speed.

Patent Documents 2 and 3 each disclose a liquid-gas agitating and mixing apparatus comprising an outer tube having a linear cylindrical shape, a rotating shaft coaxially inserted within the outer tube and rotated at a high speed, and an agitation bladed wheel in combination of a forward blade and a reverse blade which are fixed to the rotating shaft at a certain interval in the axial direction. The rotating shaft is rotated with a liquid filled in the outer tube, and gas is sucked along the rotating shaft by the sucking action due to vortex flows of the liquid. The operation of agitating and mixing the liquid and the gas is achieved with a vigorous cutting operation applied to a mixture of the liquid and the gas by individual blade pieces of the agitation bladed wheel, as well as with a mingling operation provided by collision between flow motions in the forward direction given by the forward blade and flow motions in the reverse direction given by the reverse blade.

In the apparatus disclosed in Patent Documents 2 and 3, the agitation and the mixing between the liquid and the gas are achieved with not only vortex flow motions caused by the rotating operation of the rotating shaft, but also the cutting operation of the agitation bladed wheel mounted to the rotating shaft and the collision operation between forward bubble vortex flows and reverse bubble vortex flows. Therefore, subdivision of gas bubbles can be realized in a powerful and efficient manner, whereby sufficiently subdivided gas bubbles can be obtained. As compared with the apparatus disclosed in Patent Document 1, a level of rotational speed is lower and a total weight of the rotated portion can be sufficiently reduced, whereby a level of dimensional accuracy required in forming the parts is not so very high.

The liquid-gas agitating and mixing apparatus disclosed in Patent Documents 2 and 3 is manufactured on a commercial basis and is able to generate fine gas bubbles having diameters of 10-50 μm in the liquid. As a result, the gas can be efficiently dissolved in the liquid.

In a swirling fine gas-bubble generation apparatus disclosed in Patent Document 4, a conical space is formed in a container constituting the apparatus, and a swirl flow is generated in the space by supplying a liquid under pressure in the direction tangential to an inner peripheral surface defined by an inner wall of the space. On the other hand, gas is sucked through a gas inlet formed at the bottom of the conical space in its central portion and passes along a space axis at which pressure is lowest, whereby a thin swirling gas cavity is generated. The cross-sectional area of the space is gradually reduced and the speed of the swirl flow is increased as the swirl flow advances from the inlet to an outlet. The gas continuously flows in the form of a string toward the outlet. At the same time as when the gas is discharged through the outlet, the swirl motion is abruptly weakened by the surrounding static liquid, and the string-like air cavity is continuously cut with stability. As a result, a large amount of fine gas bubbles having diameters of 10-20 μm, for example, are generated near the outlet and are released to the liquid outside the container.

Non-Patent Document 1 describes the result of measuring the number of generated gas bubbles by using a gas bubble generation apparatus which operates based on the same principle as that of the apparatus disclosed in Patent Document 4. In the gas bubble generation apparatus, water supplied to a container by a pump rises along a wall of the container, and after striking against the ceiling, the water flows toward an outlet port at a lower level along the center of a vortex flow. Gas is automatically sucked through a gas inlet due to negative pressure generated by the swirling water flow, and a gas column formed along a swirl axis is forcibly released through the outlet port together with the swirling water flow, thus generating fine gas bubbles. The capacity of a water tank is 35 liters. 1%-TFH (tetrahydrofuran) is added, as hydrate generating catalyst, to distilled water in the tank. A bubble diameter distribution is continuously measured by an optical particle distribution meter for water (LiQuilaz-E20 made in USA). The measurement is based on an optical-dynamic scattering measurement method and is performed over the range of 2 μm-125 m in terms of bubble diameter. Looking at FIG. 2 in Non-Patent Document 1, the number of gas bubbles in the liquid is measured at a pitch of 5 μm of the bubble diameter. The number of gas bubbles is maximized near the bubble diameter of 40 μm, and the gas bubbles are generated at a density of about 60 bubbles/mL within the bubble diameter range of 5 μm. On the other hand, in the zone where the bubble diameter is less than 15 μm, the gas bubbles are generated at a density of about 20 bubbles/mL within the bubble diameter range of 5 μm. It is reported that, as compared with the case using, as the liquid, distilled water containing no additives, the number of the generated fine gas bubbles is increased in the case using distilled water added with TFH or other similar material.

Patent Document 1: Japanese Examined Patent Application Publication No. 61-36448

Patent Document 2: Japanese Unexamined Patent Application Publication No. 5-220364

Patent Document 3: Japanese Unexamined Patent Application Publication No. 6-91146

Patent Document 4: Japanese Unexamined Patent Application Publication No. 2000-447

Non-Patent Document 1: "Effect of Shrinking Microbubble on Gas Hydrate Formation", The Journal of Physical Chemistry, Vol. 107, No. 10, 2003, pp 2171-2173

DISCLOSURE OF THE INVENTION

Problems to be Solved by the Invention

With the inventions described in the above-cited Patent Documents 1-4, fine gas bubbles having diameters of 10-20 μm or 10-50 μm can be generated in a liquid, and gas can be efficiently dissolved in the liquid. However, generating a large amount of micro gas bubbles having diameters of less than 15 μm, specifically less than 10 μm, in a liquid is not yet realized with those known methods. For example, in the zone where the bubble diameter is less than 15 μm, the gas bubbles are generated at a density of approximately 20 bubbles/mL within the bubble diameter range of 5 μm, and the known methods have not yet succeeded in generating the micro gas bubbles at a high density of 40 bubbles/mL or more.

The smaller the diameter of the gas bubble in the liquid, the larger is the surface tension acting upon the gas-liquid interface and the greater is the effect of raising pressure in the gas bubble. Therefore, when the diameter of the fine gas bubble is less than 15 μm, for example, the gas can be dissolved in the liquid under very high pressure. Also, the smaller the diameter of the gas bubble, the larger is the surface area of the gas-liquid interface per unit volume of the gas and the longer is a time during which the gas bubble is able reside in the liquid without floating and separating from the liquid surface. Accordingly, if micro gas bubbles having diameters of less than 15 μm, specifically less than 10 μm, can be generated in large number in addition to the fine gas bubbles, this leads to a possibility of realizing many advantages in various fields, including generation of gas hydrates, which could not be obtained in the past.

An object of the present invention is to provide a gas bubble generation method and a gas bubble generation apparatus, which can generate a large amount of micro gas bubbles having diameters of less than 15 μm, specifically less than 10 μm, in a liquid.

Means for Solving the Invention

The gist of the present invention is as follows:

(1) A method of generating micro gas bubbles in a liquid, wherein the method comprises the steps of preparing a tube 2 having a closed end 14 at one end and an open end 15 at the other end and a rotating bladed wheel 3 installed in the tube 2 and rotating coaxially or substantially coaxially with the tube 2, the rotating bladed wheel 3 having one or more blades 4, faces of the blades 4 being substantially parallel to an axis of a rotating shaft 5 of the rotating bladed wheel, immersing at least the open end 15 of the tube 2 and the rotating bladed wheel 3 in the liquid 20, and rotating the rotating bladed wheel 3 at a peripheral speed of 5.8 m/sec or higher.

(2) The method of generating micro gas bubbles in a liquid according to above (1), wherein when an average width d of the blades 4 is defined to be twice a width from a center of the rotating shaft 5 to an outer periphery of each blade 4 in the radial direction of rotation, ventilation resistance between the interior of the tube on the side near the closed end 14 of the tube 2 and outside gas is equal to or larger than that of a ventilation port 7 having an inner diameter of 0.36 time the average width d of the blades and a length of 3 mm.

(3) The method of generating micro gas bubbles in a liquid according to above (1) or (2), wherein when distilled water is used as the liquid 20, the number of gas bubbles having diameters of not less than 10 μm and less than 15 μm, which are contained in the liquid discharged from the open end 15 of the tube 2, is 40 bubbles/mL or more.

(4) A gas bubble generation apparatus for generating micro gas bubbles in a liquid, wherein the apparatus comprise a tube 2 having a closed end 14 at one end and an open end 15 at the other end, and a rotating bladed wheel 3 installed in the tube 2 and rotating coaxially or substantially coaxially with the tube 2, the rotating bladed wheel 3 having one or more blades 4, faces of the blades 4 being substantially parallel to an axis of a rotating shaft 5 of the rotating bladed wheel, the rotating bladed wheel 3 being able to rotate at a peripheral speed of 5.8 m/sec or higher when the open end 15 of the tube and the rotating bladed wheel 3 are immersed in the liquid 20 on condition that an average width d of the blades is defined to be twice a width from a center of the rotating shaft 5 to an outer periphery of each blade 4 in the radial direction of rotation.

(5) The gas bubble generation apparatus for generating micro gas bubbles in a liquid according to above (4), wherein ventilation resistance between the interior of the tube on the side near the closed end 14 of the tube and outside gas is equal to or larger than that of a ventilation port 7 having an inner diameter of 0.36 time the average width d of the blades and a length of 3 mm.

(6) The gas bubble generation apparatus for generating micro gas bubbles in a liquid according to above (4) or (5), wherein a distance L3 from the open end 15 of the tube 2 to the rotating bladed wheel 3 is 0.5 or more time the average width d of the blades.

(7) The gas bubble generation apparatus for generating micro gas bubbles in a liquid according to any one of above (4) to (6), wherein an inner diameter D of the tube is within a range of 1.1-2.5 times the average width d of the blades.

(8) The gas bubble generation apparatus for generating micro gas bubbles in a liquid according to any one of above (4) to (7), wherein a length L2 of the blade in the axial direction of the rotating shaft is 0.2 or more time the average width d of the blades.

(9) The gas bubble generation apparatus for generating micro gas bubbles in a liquid according to any one of above (4) to (8), wherein the blade 4 is formed of a plate having one or more holes 12 formed in the face thereof.

(10) The gas bubble generation apparatus for generating micro gas bubbles according to any one of above (4) to (9), wherein a partially opened sheet 16 having a large number of openings is provided at the open end of the tube or between the open end 15 of the tube and the rotating bladed wheel 3.

(11) The gas bubble generation apparatus for generating micro gas bubbles in a liquid according to any one of above (4) to (10), wherein when distilled water is used as the liquid 20 and the gas bubbles are generated by immersing at least the open end 15 of the tube 2 and the rotating bladed wheel 3 in the liquid, the number of gas bubbles having diameters of not less than 10 μm and less than 15 μm, which are contained in the liquid discharged from the open end 15 of the tube, is 40 bubbles/mL or more.

(12) The method of generating micro gas bubbles in a liquid according to any one of above (1) to (3), wherein a distance L3 from the open end 15 of the tube 2 to the rotating bladed wheel 3 is 0.5 or more time the average width d of the blades.

(13) The method of generating micro gas bubbles in a liquid according to any one of above (1) to (3) and (12), wherein an inner diameter D of the tube 2 is within a range of 1.1-2.5 times the average width d of the blades.

(14) The method of generating micro gas bubbles in a liquid according to any one of above (1) to (3) and (12) to (13), wherein a length L2 of the blade in the axial direction of the rotating shaft is 0.2 or more time the average width d of the blades.

(15) The method of generating micro gas bubbles in a liquid according to any one of above (1) to (3) and (12) to (14), wherein the blade 4 is formed of a plate having one or more holes 12 formed in the face thereof.

Advantages of the Invention

According to the present invention, the method of generating fine gas bubbles and the fine gas bubble generation apparatus are provided in which the gas bubbles are generated by using the tube having the closed end at one end and the open end at the other end and the rotating bladed wheel installed in the tube and rotating coaxially or substantially coaxially with the tube, and by immersing the open end of the tube and the rotating bladed wheel in the liquid. The rotating bladed wheel has one or more blades, and the faces of the blades are substantially parallel to the axis of the rotating shaft of the rotating bladed wheel. By rotating the rotating bladed wheel at a high speed while reducing an amount of the outside gas supplied from the closed end side, a large amount of micro gas bubbles having diameters of less than 15 μm can be generated in the liquid discharged from the open end of the tube.

BRIEF DESCRIPTION OF THE DRAWINGS

FIG. 1 shows a gas bubble generation apparatus according to the present invention in which; FIG. 1(*a*) is a sectional view, FIG. 1(*b*) is a sectional view taken along the line A-A and viewed in the direction of arrow, FIG. 1(*c*) is a sectional view taken along the line B-B and viewed in the direction of arrow, FIG. 1(*d*) is a sectional view taken along the line C-C and viewed in the direction of arrow, and FIG. 1(*e*) is a perspective view showing a shape of a rotating bladed wheel.

FIG. 2 shows shapes of rotating bladed wheels in the present invention in which; FIGS. 2(*a*1), 2(*b*1), 2(*c*) and 2(*d*) are each a front view, FIG. 2(*a*2) is a bottom view looking the rotating bladed wheel of FIG. 2(*a*1) from below, and FIG. 2(*b*2) is a view taken along the line A-A and viewed in the direction of arrow.

FIG. 3 shows shapes of rotating bladed wheels in the present invention in which; FIGS. 3(*a*1) and 3(*b*) are each a front view, FIG. 3(*a*2) is a bottom view looking the rotating bladed wheel of FIG. 3(*a*1) from below, and FIGS. 3(*c*)-3(*e*) are bottom views looking three kinds of rotating bladed wheels from below, which have the same front view as FIG. 3(*b*), but have different numbers of blades.

FIG. 4 shows shapes of rotating bladed wheels in the present invention in which; FIGS. 4(*a*1) and 4(*b*) are each a front view, and FIG. 4(*a*2) is a bottom view looking the rotating bladed wheel of FIG. 4(*a*1) from below.

FIG. 8 shows a gas bubble generation apparatus according to the present invention in which; FIG. 8(*a*) is a sectional view, FIG. 8(*b*) is a sectional view taken along the line A-A and viewed in the direction of arrow, FIG. 8(*c*) is a sectional view taken along the line B-B and viewed in the direction of arrow, and FIG. 8(*d*) is a sectional view taken along the line C-C and viewed in the direction of arrow.

REFERENCE NUMERALS

Figure 1:
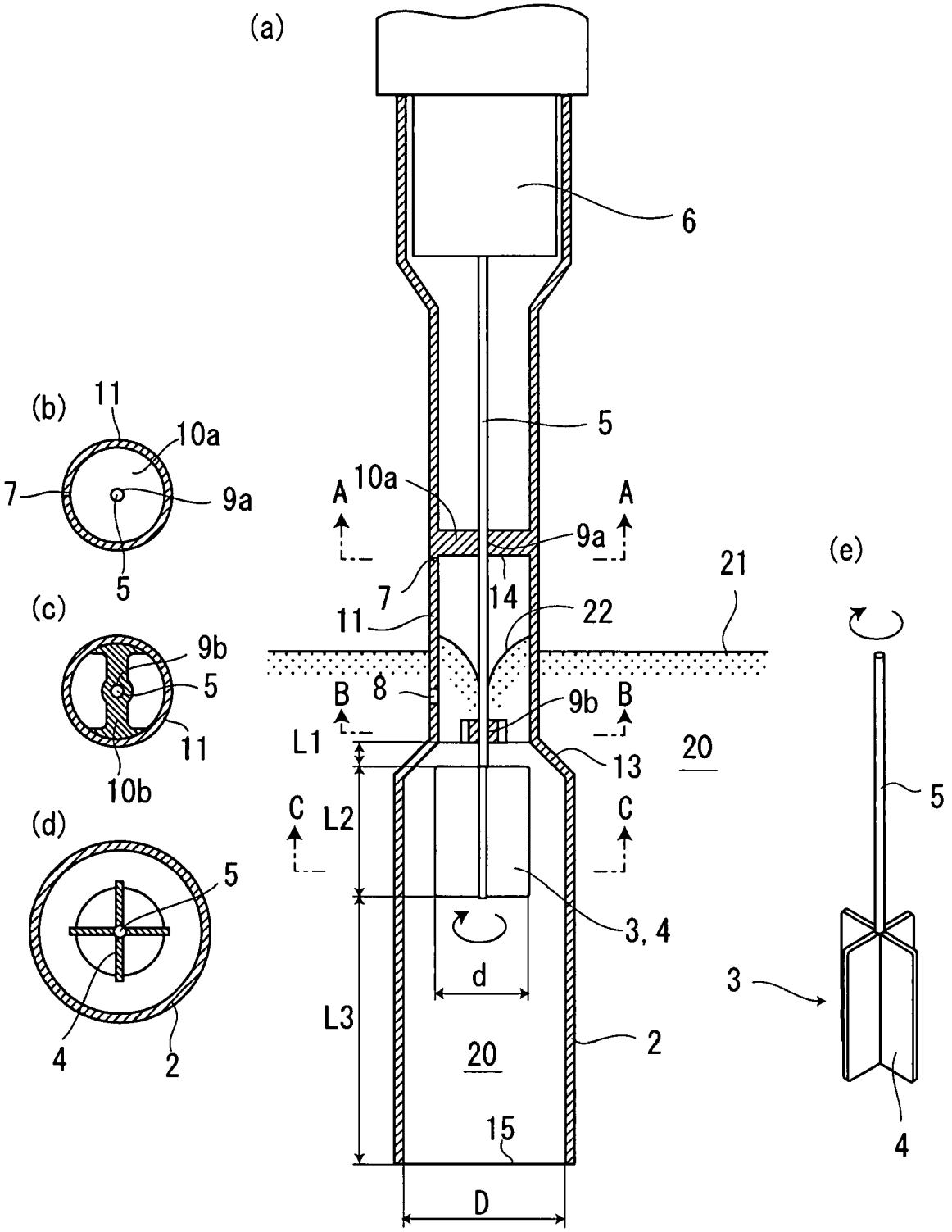

2 tube
3 rotating bladed wheel
4 blade
5 rotating shaft
6 motor
7 ventilation port
8 liquid communication port
9 bearing
10 support member
11 tube
12 hole
13 shoulder
14 closed end
15 open end
16 partially opened sheet
20 liquid
21 liquid surface
22 liquid surface
31 normal line to face of blade
32 plane perpendicular to axis of rotating shaft
33 circumferential direction of rotation
D inner diameter of tube
d average width of blades

BEST MODE FOR CARRYING OUT THE INVENTION

In the present invention, as shown in FIG. 1, micro gas bubbles are generated by using a tube 2 having a closed end 14 at one end and an open end 15 at the other end, and a rotating bladed wheel 3 installed in the tube 2 and rotating coaxially or substantially coaxially with the tube 2. The open end 15 of the tube 2 and the rotating bladed wheel 3 are immersed in a liquid 20 and the rotating bladed wheel 3 is rotated, whereby a large amount of micro gas bubbles having diameters of less than 15 μm can be generated in the liquid.

The tube 2 may be, e.g., a cylindrical, hexagonal, or octagonal tube, but the cylindrical tube is preferably used.

The expression "rotating bladed wheel 3 rotating coaxially or substantially coaxially with the tube 2" means that a rotating shaft of the rotating bladed wheel 3 is coaxially with the tube or is eccentric from the center axis of the tube 2 within a certain slight range. An allowable degree of the eccentricity is that the rotating shaft of the rotating bladed wheel 3 is deviated from the center axis of the tube 2 within 0.2×d. Also, the eccentricity of the rotating shaft of the rotating bladed wheel 3 from the center axis of the tube 2 is allowable within 15°.

Major features of the present invention enabling a large amount of micro gas bubbles having diameters of less than 15 μm to be generated in the liquid reside in (1) a shape of the blade 4 of the rotating bladed wheel 3, (2) a sufficient peripheral rotational speed of the rotating bladed wheel 3, (3) proper adjustment of an amount of gas supplied as a source for the gas bubbles, and (4) proper setting of a distance L3 between the open end 15 of the tube 2 and the rotating bladed wheel 3. Those major features will be described below one by one.

The first feature of the present invention, i.e., a shape of the blade 4 of the rotating bladed wheel 3, will be described.

In the liquid-gas agitating and mixing apparatus disclosed in Patent Document 1, the drive member having the linear columnar shape is inserted coaxially within the outer shell member having the linear cylindrical shape, and it is rotated at a high speed such that the liquid having entered the gap between the outer shell member and the drive member is vigorously agitated and the liquid containing a large number of fine gas bubbles is released through the opening at the lower end of the outer shell member. On the other hand, in the liquid-gas agitating and mixing apparatus disclosed in Patent Documents 2 and 3, the gas bubbles are cut by the cutting operation of the agitation bladed wheel mounted to the rotating shaft, and the agitation bladed wheel is constituted by the combination of the forward blade and the reverse blade so as to cause the collision operation between forward bubble vortex flows and reverse bubble vortex flows, thereby achieving subdivision of the gas bubbles. With the methods described in Patent Documents 1-3, a larger amount of gas bubbles having diameters of 10-20 μm can be generated in the liquid, but those known methods have not yet succeeded in generating a large amount of gas bubbles having diameters of less than 15 μm.

Figure 4:
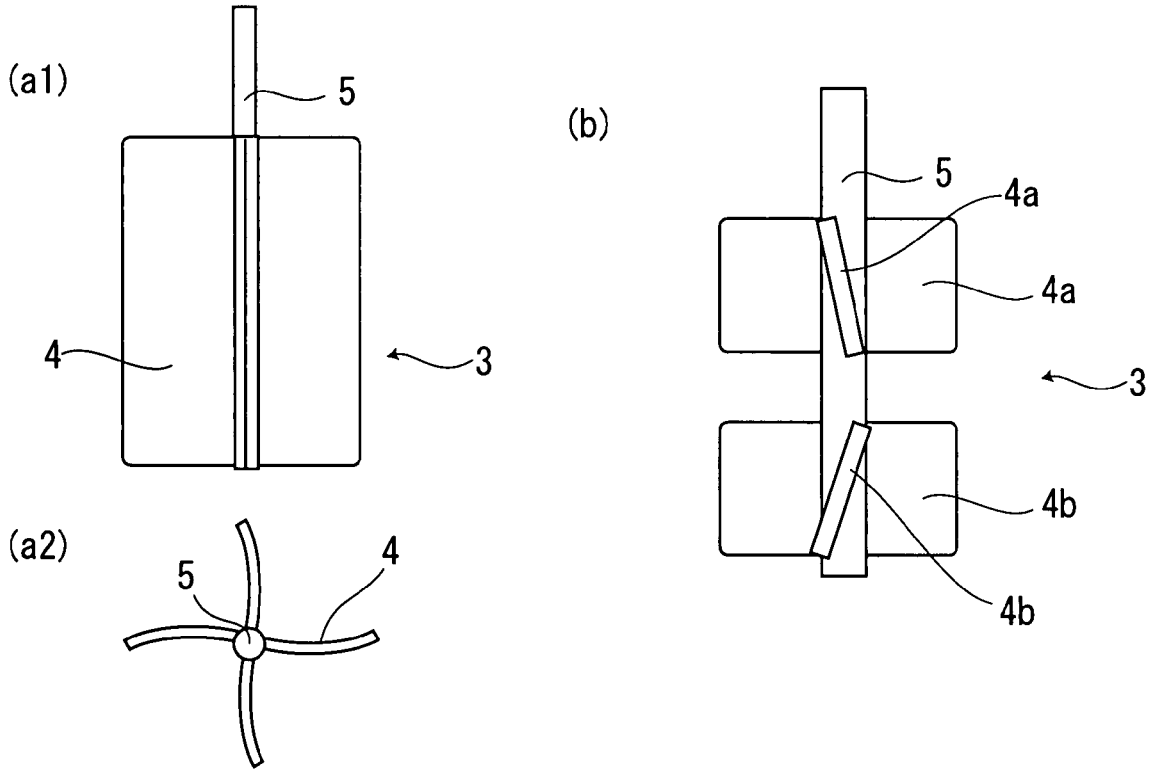
Figure 5:
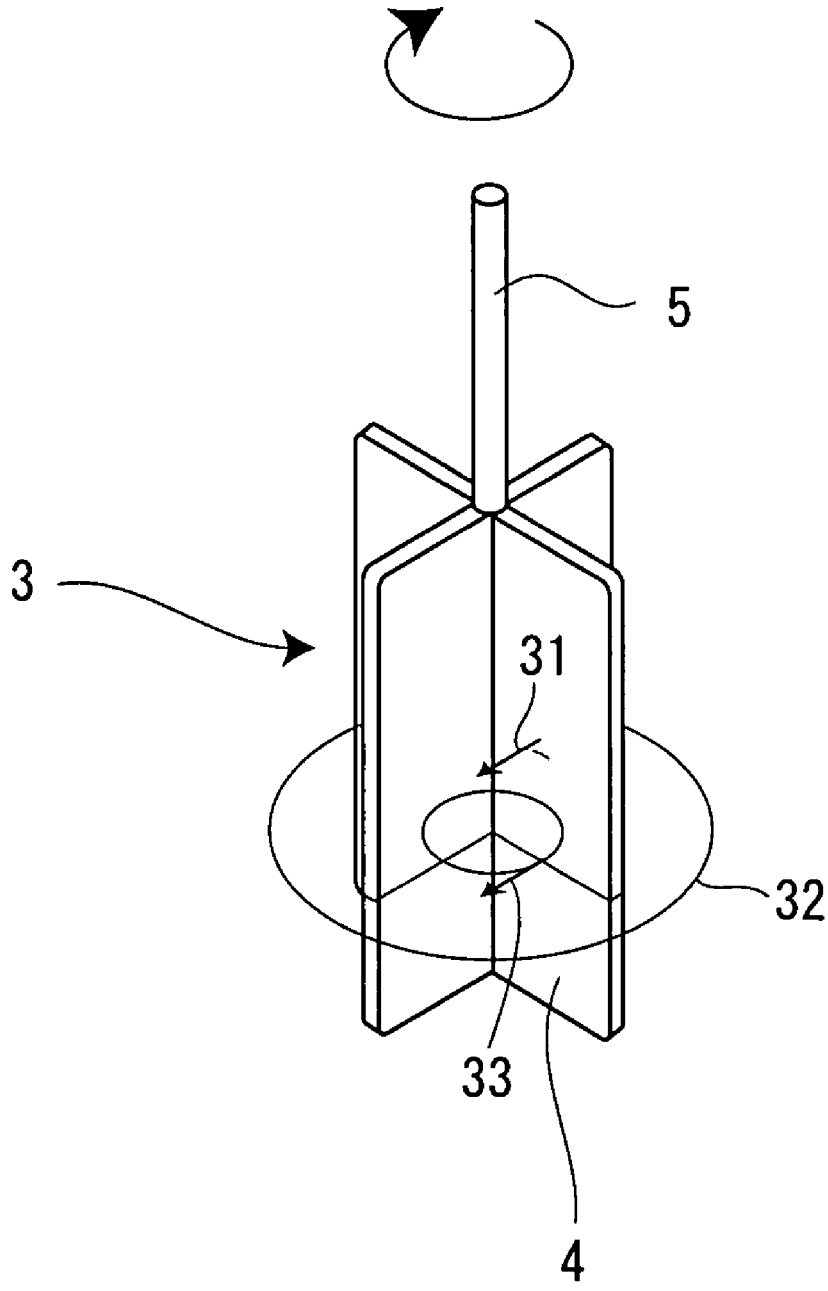
FIG. 5 is a perspective view of the rotating bladed wheel in the present invention.

As shown in FIGS. 1(*a*) and 1(*e*), the rotating bladed wheel 3 in the present invention is featured in that it has one or more blades 4 and the face of each blade 4 is substantially parallel to the axis of a rotating shaft 5 of the rotating bladed wheel 3. The expression "the face of each blade 4 is substantially parallel to the axis of a rotating shaft 5 of the rotating bladed wheel 3" means that a normal line to the face of the blade 4 has no component directed upward or downward along the axis of the rotating shaft 5 and the rotation of the rotating bladed wheel 3 does not produce a driving force to move the liquid along the rotating shaft. In other words, as shown in FIG. 5, a normal line 31 to the face of the blade 4 is substantially parallel to a plane 32 extending perpendicularly to the axis of the rotating shaft 5. In an example shown in FIGS. 4(*a*1) and 4(*a*2), the face of the blade 4 is a curved face, but a normal line to the face of the blade 4 is parallel to a plane extending perpendicularly to the axis of the rotating shaft 5 at any position on the face of the blade 4. Hence such an example also falls within the scope of the present invention.

More preferably, as shown in FIG. 5, the normal line 31 to the face of the blade is substantially oriented in a circumferential direction 33 of rotation of the rotating bladed wheel. With such an arrangement, a force for driving the liquid in the radial direction of the rotating shaft 5 is only given by a centrifugal force applied to the liquid, and the blade itself does not provide the force for driving the liquid in the radial direction of the rotating shaft.

The shape of the blade 4 constituting the rotating bladed wheel 3 can also be said as being in the form of a plate. As a result of the construction that the blade is in the form of a plate and the normal line 31 to the face of the plate is oriented as described above, energy produced with the rotation of the blade is consumed only by agitating the liquid in the tube. Also, because the force for driving the liquid along the rotating shaft is not produced with the rotation of the rotating bladed wheel 3 itself, the liquid 20 in the tube 2 is not moved parallel to the rotating shaft and is able to reside near the rotating bladed wheel for a sufficiently long time during which the gas bubbles in the liquid are subdivided into bubbles having diameters of less than 15 μm.

Figure 9:
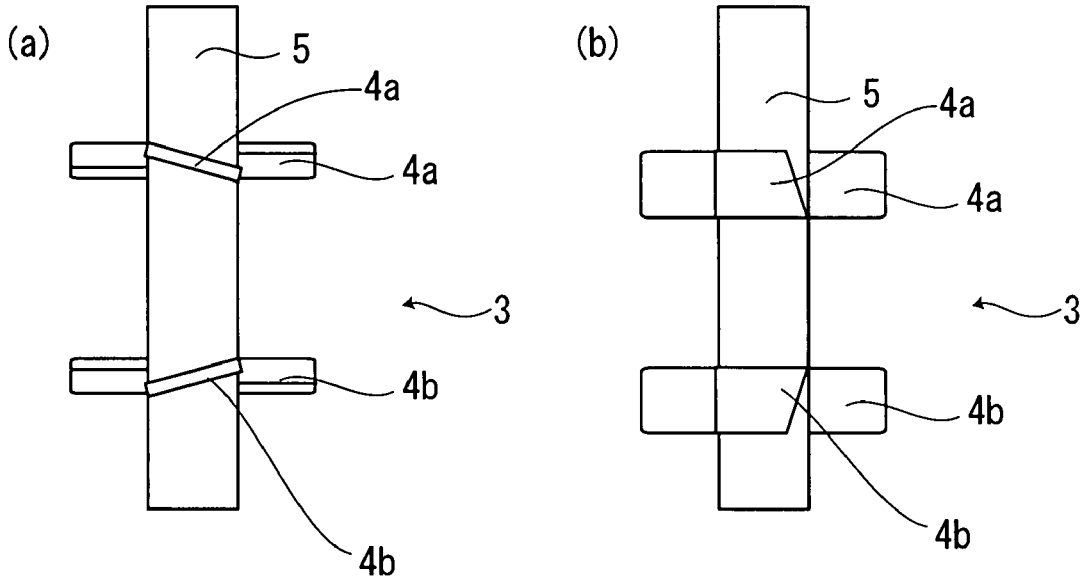
FIGS. 9(*a*) and 9(*b*) is a view showing shapes of known rotating bladed heels.

In the apparatus disclosed in Patent Documents 2 and 3, with intent to obtain the effect of cutting the gas bubbles by the agitation bladed wheel and to produce forces for driving the liquid in the forward and reverse directions along the rotating shaft (by the actions of the forward blade and the reverse blade), the blade is shaped, as shown in FIG. 9(*a*), such that the face of each blade 4 is extended substantially perpendicularly to the rotating shaft 5. Eventually, the blade having a small cross-sectional area in a section perpendicular to the circumferential direction of the rotation is used. In the present invention, the conception for arrangement of the blade is changed such that the face of the blade is substantially parallel to the rotating shaft 5. As a result, the surface area of the blade provides in itself a cross-sectional area in the section perpendicular to the circumferential direction 33 of the rotation, and the blade having a large cross-sectional area in that section is used.

Thus, in the present invention, by using the blade 4 in the above-described way and arranging the blade 4 such that the face of the blade 4 is substantially parallel to the axis of the rotating shaft 5, it is possible to apply a very powerful agitation force to the liquid in the tube within which is rotated the rotating bladed wheel, and to generate a large amount of micro gas bubbles having diameters of less than 15 μm in the liquid by so powerfully agitating the liquid.

Herein, the expression "the face of the blade 4 is substantially parallel to the axis of the rotating shaft 5 of the rotating bladed wheel" means that, even when the face of the blade 4 is deviated from a location parallel to the axis of the rotating shaft 5 of the rotating bladed wheel, the deviation is held within ±15° at maximum. More preferably, the deviation is held within ±10°. In the rotating bladed wheel 3 shown in FIG. 2(*a*), the face of the blade 4 is parallel to the axis of the rotating shaft 5 of the rotating bladed wheel. In the rotating bladed wheel 3 shown in FIG. 4(*b*), the face of the blade 4 is deviated about 15° from a location parallel to the axis of the rotating shaft 5 of the rotating bladed wheel. When the deviation is held at such a level of angle, the advantages of the present invention can be sufficiently provided.

Also, in more preferable orientation of the face of the blade, a normal line to the blade face is substantially oriented in the circumferential direction of rotation of the rotating bladed wheel. In such a case, the above expression means that, even when the direction of the normal line 31 to the blade face is deviated from the circumferential direction 33 of rotation of the rotating bladed wheel, the deviation is held within ±15° at maximum. More preferably, the deviation is held within ±10°. In the rotating bladed wheel 3 shown in FIG. 2(*a*), the normal line to the blade face is directed in the circumferential direction of rotation of the rotating bladed wheel. In the rotating bladed wheel 3 shown in FIG. 4(*a*), the face of the blade 4 is a curved face and the normal line to the blade face is not oriented in a certain one direction. However, the direction of the normal line to the blade face is deviated about 15° from the circumferential direction of rotation of the rotating bladed wheel. When the deviation is held at such a level of angle, the advantages of the present invention can be sufficiently provided.

In the following description, as shown in FIG. 1, an average width d of the blades is defined to be twice the width from the center of the rotating shaft to the outer periphery of the blade in the radial direction of the rotation.

There is also a preferable range for the relationship between an inner diameter D of the tube 2 and the blade average width d of the rotating bladed wheel 3. Herein, when the tube 2 is a cylindrical tube, the inner diameter D represents an inner diameter of the cylindrical tube. When the tube 2 is a tube other than the cylindrical tube, such as a hexagonal tube, the inner diameter D represents minimum one of diameters corresponding to the inner shape of the tube. If the tube inner diameter D is too large in comparison with the blade average width d, the liquid is not sufficiently agitated within the tube and the amount of generated micro gas bubbles having diameters of less than 15 μm is reduced eventually. In the present invention, the tube inner diameter D is preferably 2.5 or less times the blade average width d. The ratio between them is more preferably 2.3 or less and even more preferably 2.0 or less.

On the other hand, if the tube inner diameter D is too close to the blade average width d, the liquid 20 is rotated together with the blades 4 and is not sufficiently agitated, whereby the amount of generated micro gas bubbles having diameters of less than 15 μm is reduced eventually. In the present invention, the tube inner diameter D is preferably 1.1 or more times the blade average width d. The ratio between them is more preferably 1.2 or more.

In the present invention, the rotating bladed wheel 3 has one or more blades. The number of blades is not limited to a particular one, but the number of about 3-6 is particularly preferable. For the rotating bladed wheel in which the blade has the shape shown in FIG. 3(*b*), FIG. 3(*c*) shows the case having three blades 4, FIG. 3(*d*) shows the case having six blades 4, and FIG. 3(*e*) shows the case having eight blades 4. When the number of the blades 4 is four and the four blades 4 are arranged at equal intervals in the rotating direction as shown in FIG. 2(*a*1), the four blades 4 have a cross-like shape, as shown in FIG. 2(*a*2), when viewed in the axial direction of the rotating shaft 5.

From the viewpoint of generating a sufficient amount of micro gas bubbles having diameters of less than 15 μm in the liquid according to the present invention, there is a preferable range for a length L2 of the blade 4 of the rotating bladed wheel 3 in the axial direction of the rotating shaft 5. When the rotating bladed wheel 3 in the present invention has a plurality of blades (4*a*, 4*b*) arranged apart from each other in the axial direction of the rotating shaft as shown in FIG. 2(*c*), the length L2 represents a total of lengths of all the blades arranged apart from each other in the axial direction of the rotating shaft. In the case of FIG. 2(*c*), the length L2 is given by L2=L2*a*+L2*b*. If the blade length L2 in the axial direction of the rotating shaft is too short in comparison with the blade average width d, the liquid is not sufficiently agitated within the tube 2 and the amount of generated micro gas bubbles having diameters of less than 15 μm is reduced eventually. In the present invention, the blade length L2 in the axial direction of the rotating shaft is preferably 0.2 or more time the blade average width d. The ratio between them is more preferably 0.5 or more and even more preferably 1.0 or more.

Figure 2:
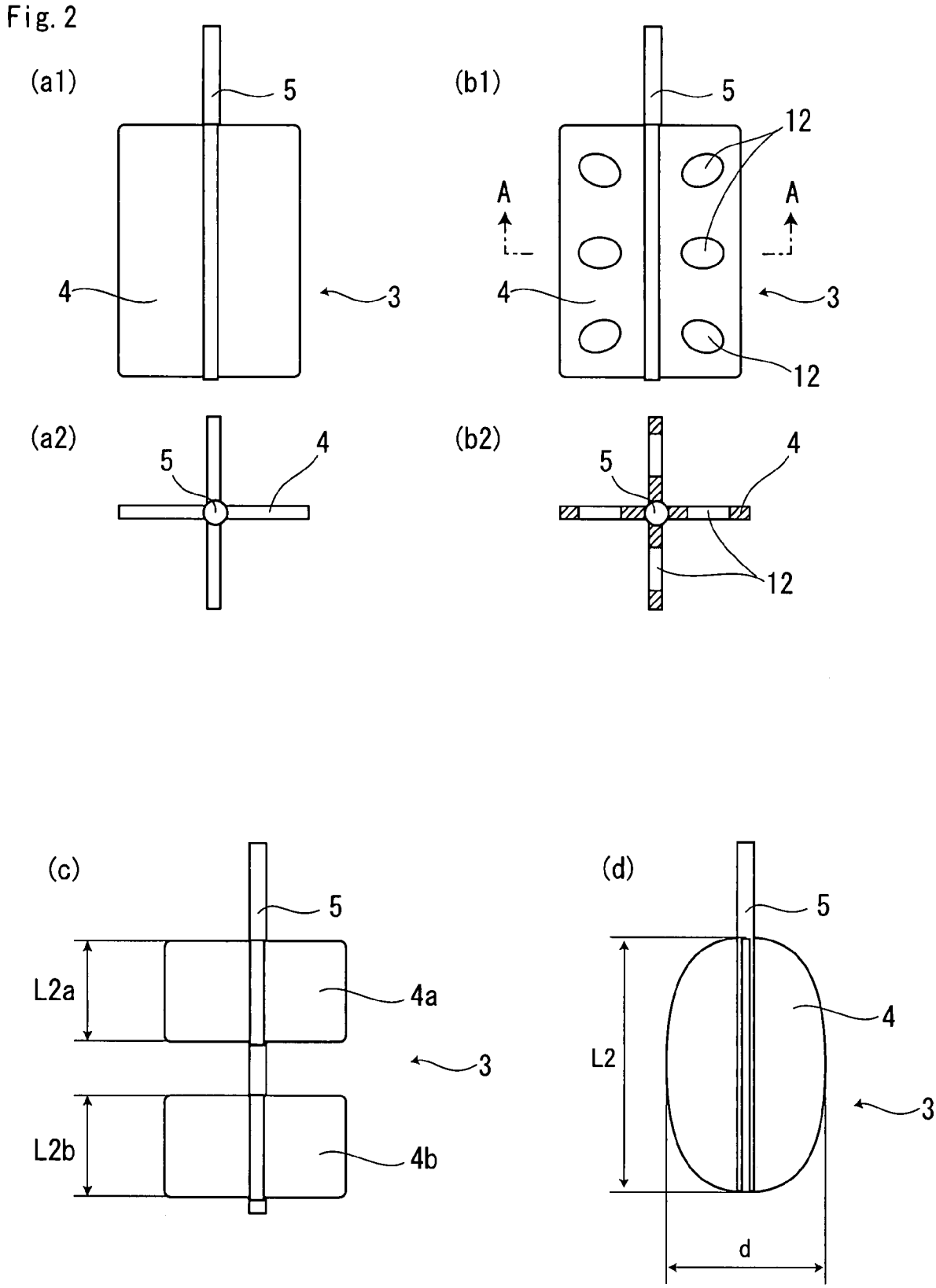

The shape of the blade 4 of the rotating bladed wheel 3 is not limited to a quadrilateral shape such as a rectangular or square shape shown in FIGS. 2(*a*)-2(*c*), and it can be set to any of various shapes including an elliptic shape shown in FIG. 2(*d*). When the blade 4 has a shape other than the quadrilateral, the blade average width d can be defined as being twice the width from the center of the rotating shaft to the outermost periphery of the blade in the radial direction of the rotation, as shown in FIG. 2(*d*). Also, the blade length L2 in the axial direction of the rotating shaft can be defined as shown in FIG. 2(*d*).

Figure 3:
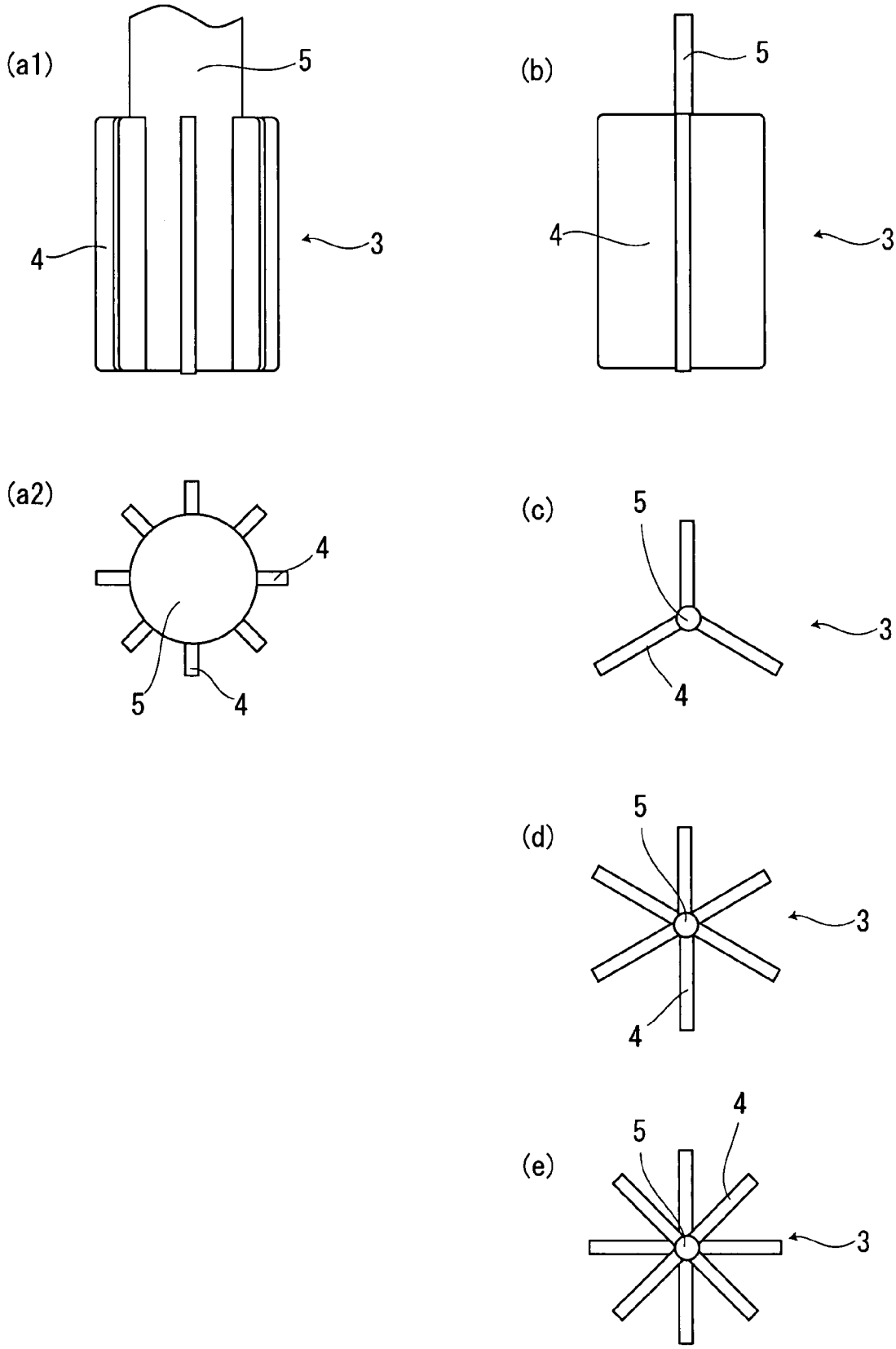

The rotating bladed wheel 3 in the present invention may be formed, as shown in FIGS. 3(*a*1) and 3(*a*2), such that a shaft having a relatively large diameter is used as a central shaft 5 and blades 4 are arranged around the central shaft 4.

The blade 4 in the present invention may be constituted, as shown in FIG. 2(*b*), by a plate having one or more holes 12 formed in its surface. The presence of the holes 12 formed in the plate surface is advantageous in generating the micro gas bubbles because of an effect of reducing fluid resistance when the rotating bladed wheel 3 is rotated, and in increasing a rotational speed when the rotating bladed wheel is rotated by a motor having the same output power. Further, the presence of the holes 12 can make flows of the liquid 20 more complicated so as to increase the agitation effect.

The blade 4 of the rotating bladed wheel 3 in the present invention can be made of any material so long as it can be formed in a plate-like shape and is endurable against the high-speed rotation in the liquid. Among various materials, a metal and a reinforced plastic are preferable because the blade can be formed as a plate having a small thickness by using such a material.

The second feature of the present invention,. i.e., the peripheral rotational speed of the rotating bladed wheel 3, will be described below. The term "the peripheral rotational speed of the rotating bladed wheel 3" means the speed of an outermost peripheral portion of the blade 4 in the circumferential direction of rotation when the rotating bladed wheel 3 is rotated.

By ensuring a preferable peripheral speed as the peripheral rotational speed of the rotating bladed wheel 3, the feature of the present invention can be realized in point of generating a large amount of micro gas bubbles having diameters of less than 15 μm in the liquid. The reason is that, as the peripheral rotational speed of the rotating bladed wheel 3 increases, the force for agitating the liquid in the tube is increased and subdivision of the gas bubbles is progressed. By immersing the open end 15 of the tube 2 and the rotating bladed wheel 3 in the liquid and rotating the rotating bladed wheel 3 at a peripheral speed of 5.8 m/sec or higher, the micro gas bubbles can be generated. For example, when the blade average width d is 22 mm, the rotational speed of the rotating bladed wheel is set to be 5037 rpm or higher. The peripheral speed of the rotating bladed wheel is more preferably 7 m/sec or higher and even more preferably 9 m/sec or higher.

The third feature of the present invention, i.e., supply of the gas as a source for the gas bubbles, will be described below.

In the known gas-liquid agitating apparatuses described in Patent Documents 1-4, the outside gas is positively taken into the agitating apparatuses to be mixed in the liquid, to thereby generate a large amount of gas bubbles in the liquid. However, when the outside gas is taken into the liquid as in the known apparatuses, a large amount of gas bubbles are generated in the liquid and the bulk volume of the liquid is increased. Eventually, the conditions for generating the micro gas bubbles are not satisfied for the reason that the liquid is so quickly replaced in an agitation region and the depressurization effect in a substantially enclosed space in the upper portion of the tube is reduced. Thus, the diameters of the gas bubbles generated in the liquid cannot be sufficiently reduced to micro sizes.

In the present invention, the tube 2 having the closed end 14 at one end and the open end 15 at the other end is used as the tube 4 for containing the rotating bladed wheel 3. In an embodiment shown in FIG. 1, a support member 10*a* has the function of supporting a bearing 9*a* which in turn supports the rotating shaft 5, and the function of closing one tube end to form the closed end 14. The open end 15 of the tube 2 is immersed in the liquid 20, and therefore gas does not enter the tube from the open end 15. Further, in the present invention, ventilation resistance between the interior of the tube 2 on the side near the closed end 14 and the outside gas is increased to suppress the amount of gas supplied from the closed end side. As a result, because the amount of gas bubbles generated in the liquid per unit time is suppressed, the liquid agitated in the tube is able to reside near the rotating bladed wheel 3 in the tube for a sufficiently long time, and a sufficient amount of micro gas bubbles can be generated in the liquid.

The ventilation resistance between the interior of the tube on the side near the closed end and the outside gas is set equal to or larger than that of a ventilation port 7 having an inner diameter of 0.36 time the blade average width d and a length of 3 mm. Usually, the ventilation port 7 having a small diameter is bored near the closed end 14 of the tube, and the tube 2 is arranged such that a position on the tube surface where the ventilation port 7 is bored is exposed to the outside gas (i.e., not immersed in the liquid). A gas-liquid interface 22 exists as a boundary between the gas phase and the liquid phase within the tube near the closed end. With agitation of the liquid phase, the gas phase is successively taken into the liquid phase to generate gas bubbles. As a result, the gas-liquid interface 22 rises within the tube and the pressure of the gas phase becomes negative with respect to that of the outside gas. Correspondingly, the outside gas is supplied in a required amount to the interior of the tube through the ventilation port 7.

The interior of the tube and the outside gas are communicated with each other through not only the ventilation port 7, but also a gap between the rotating shaft 5 of a motor 6 and the bearing 9. In estimating the ventilation resistance, therefore, the gap between the rotating shaft 5 of the motor 6 and the bearing 9 has to be also taken into consideration. Further, if the gap between the rotating shaft 5 of the motor 6 and the bearing 9 serves as a ventilation port which satisfies a necessary and sufficient condition for generating a large amount of the micro gas bubbles, an additional ventilation port is not required to be formed separately.

Even when the apparatus is designed such that the ventilation port 7 is not formed and the amount of the outside gas entering the cylindrical tube through the gap between the rotating shaft 5 of the motor and the bearing 9 is zero, it is also possible to generate the micro gas bubbles in the liquid by employing the present invention. Such a result is presumably attributable to the fact that when the liquid 20 in the tube is rotated by the rotating bladed wheel 3, a depressurized region is locally produced on the back side of the rotating bladed wheel 3 and a gas component dissolved in the liquid is evaporated in the depressurized region to become gas bubbles, which are reduced in size to a micro level with the agitation.

In the present invention, the ventilation resistance between the interior of the tube 2 on the side near the closed end 14 and the outside gas is preferably set equal to or larger than that of the ventilation port 7 having the inner diameter of 0.16 time the blade average width d and a length of 3 mm. More preferably, the ventilation resistance is set equal to or larger than that of the ventilation port 7 having the inner diameter of 0.1 time the blade average width d and a length of 3 mm. Even more preferably, the ventilation resistance is set equal to or larger than that of the ventilation port 7 having the inner diameter of 0.06 time the blade average width d and a length of 3 mm.

In the present invention, the open end 15 of the tube serves as a primary liquid passage through which the liquid containing a sufficient amount of the micro gas bubbles in the tube is discharged out of the tube and conversely the fresh liquid is supplied into the tube. The liquid agitated in the tube with the rotation of the rotating bladed wheel 3 is pressed against the inner peripheral surface of the tube 2 by the action of a centrifugal force caused with the rotation, and a part of the liquid is discharged to the exterior of the tube 2 through the open end 15 along the inner peripheral surface of the tube 2. Simultaneously, the liquid is introduced to the interior of the tube through the open end 15 primarily through a route near the axis of the tube 2 in substantially the same amount as the liquid that is discharged to the exterior of the tube.

The fourth feature of the present invention, i.e., the distance L3 from the open end 15 of the tube to the rotating bladed wheel 3, will be described below.

The liquid introduced to the interior of the tube is required to reside within the tube near the rotating bladed wheel 3 under agitation for a time sufficient for the liquid to contain a large number of the micro gas bubbles. In the present invention, the residing time of the liquid within the tube can be controlled by adjusting the distance L3 from the open end 15 of the tube to the rotating bladed wheel 3. More specifically, the distance L3 from the open end 15 of the tube to the rotating bladed wheel 3 is preferably set to be 0.5 or more time the blade average width d from the viewpoints of suppressing a phenomenon that the liquid introduced to the interior of the tube is too quickly discharged out of the tube, and of enabling the liquid to be agitated by the rotating bladed wheel 3 until the liquid contains a sufficient amount of the micro gas bubbles. The distance L3 from the open end 15 of the tube to the rotating bladed wheel 3 is set to be more preferably 1.0 or more times and even more preferably 2.0 or more times the blade average width d.

Figure 6:
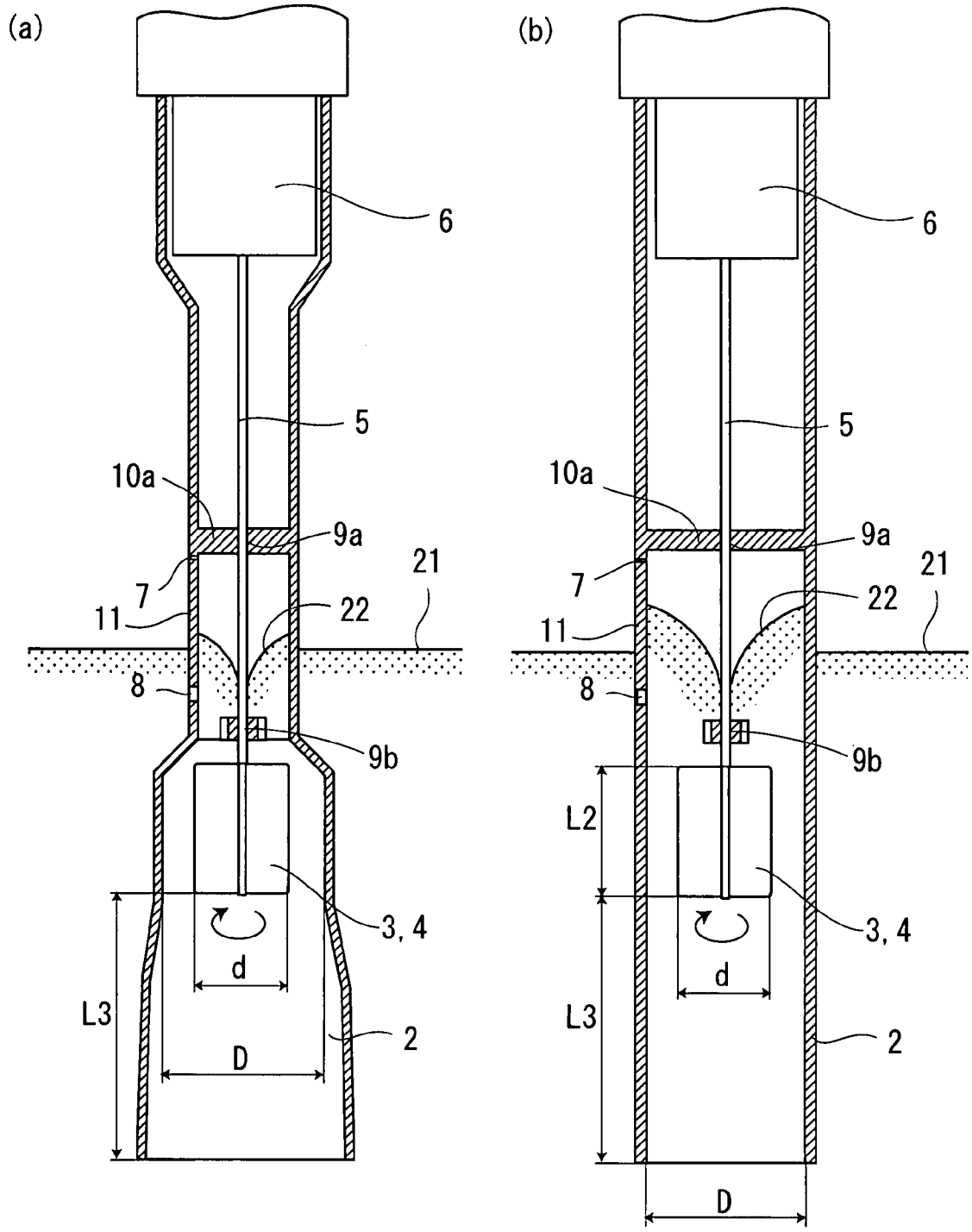
FIGS. 6(*a*) and 6(*b*) is a sectional view showing the gas bubble generation apparatus according to the present invention.

As described above, the tube inner diameter D has the preferable range which can be expressed in terms of ratio with respect to the blade average width d. Herein, the term "the tube inner diameter D" means the inner diameter of the tube 2 in a tube portion where the rotating bladed wheel 3 is arranged. On the other hand, the distance L3 from the open end 15 of the tube to the rotating bladed wheel 3 also has the preferable range as described above. The inner shape of the tube in a region from the rotating bladed wheel 3 to the open end 15 of the tube can be set to have the same inner diameter as that of the inner shape corresponding to the above-described preferable range in the tube portion where the rotating bladed wheel 3 is disposed, as shown in FIG. 1. On the other hand, the inner shape of the tube 2 in the region from the rotating bladed wheel 3 to the open end 15 of the tube may be changed to a conical downward-spreading shape, for example, as shown in FIG. 6(*a*). Such a modification can also provide the advantages of the present invention. Of course, the tube inner shape in that region may be changed to a conical downward-converging shape.

Figure 7:
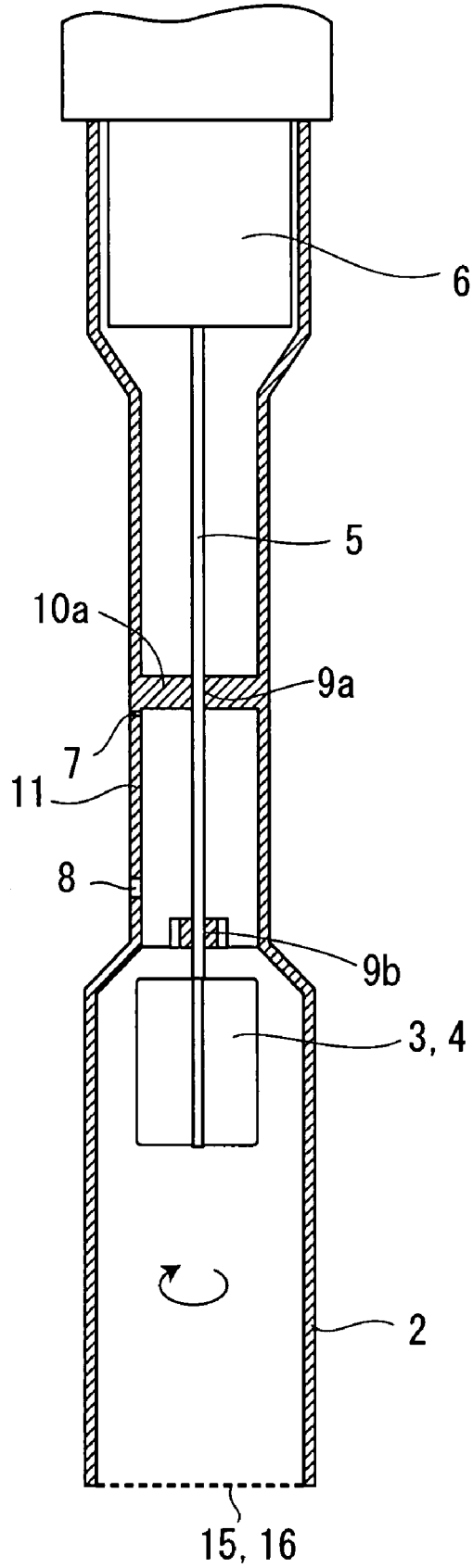
FIG. 7 is a sectional view showing the gas bubble generation apparatus according to the present invention, which includes a partially opened sheet.

In the present invention, as shown in FIG. 7, a partially opened sheet 16 having a large number of openings is preferably disposed at the open end 15 of the tube or between the open end 15 of the tube and the rotating bladed wheel 3 for the reason that the provision of the partially opened sheet 16 contributes to increasing the amount of the micro gas bubbles generated in the liquid. The partially opened sheet 16 having a large number of openings can be formed of, e.g., a mesh, a punched metal, or a grid. In the case of a mesh, it can be formed by braiding thin metal wires with a diameter of about 0.5 mm, for example, into a square wire net such that an infinite number of openings of about 1 mm×1 mm are formed. As an alternative, similar advantages can also be obtained by using the partially opened sheet 16 formed by braiding a synthetic resin thread into a net in which openings of about 5 mmϕ are arrayed at a high density with a pitch of 7.5 mm. By arranging the thus-formed partially opened sheet 16 so as to cover the open end 15 of the tube, or by installing it in a liquid path between the open end 15 of the tube and the rotating bladed wheel 3, it is possible to increase the number of the micro gas bubbles contained in the liquid flowing out from the open end. In addition, by providing the partially opened sheet 16 as described above, it is also possible to prevent a risk that an operator's finger may be pinched by the rotating blades.

An inlet/outlet port for allowing the liquid 20 to move between the interior and the exterior of the tube 2 is not limited to only the open end 15 of the tube, and a liquid communication port 8 may be formed in the tube on the side near the closed end, as shown in FIG. 1, such that the interior and the exterior of the tube is communicated with each other through both the open end 15 and the liquid communication port 8.

In the present invention, by properly selecting the blade average width d of the rotating bladed wheel, a gas bubble generation apparatus having a size and capacity depending on the intended use can be constructed over the range from a small- to large-sized gas bubble generation apparatus. The blade average width d of the rotating bladed wheel 3 is preferably 5-50 mm for the reason that, when the blade average width d is within such a range, the capacity of generating the micro gas bubbles can be obtained and a compact gas bubble generation apparatus can be constructed. More preferably, the blade average width d of the rotating bladed wheel 3 is 15-30 mm.

When the micro gas bubbles are generated in the liquid by using the gas bubble generation apparatus of the present invention, at least the open end 15 of the tube 2 and the rotating bladed wheel 3 are immersed in the liquid. At that time, the direction of the axis of the rotating shaft 5 of the gas bubble generation apparatus is preferably oriented in the vertical direction. However, even if the axis of the rotating shaft 5 is slightly inclined from the vertical direction, the advantages of the present invention can also be provided. More specifically, when an angle between the direction of the rotating shaft 5 and the vertical direction is about 30° or less, the advantages of the present invention can be provided. In the case of the gas bubble generation apparatus having one or both of the ventilation port 7 and the liquid communication port 8, a liquid surface 21 should be located under the position of the ventilation port 7 and above the position of the liquid communication port 8.

As a result of agitating the liquid 20 in the tube 2 with the rotation of the rotating bladed wheel 3, the level of the gas-liquid interface 22 within the tube 2 is gradually lowered at a position closer to the rotating shaft 5, as shown in FIG. 1. Herein, the expression "the rotating bladed wheel 3 is immersed in the liquid" means not only the case where the blades 4 are entirely immersed in the liquid 20, but also the case where a part of the gas-liquid interface 22 is positioned under the upper ends of the blades 4.

When the micro gas bubbles are generated by immersing the gas bubble generation apparatus of the present invention in the liquid, it is advantageous to leave a certain distance between the bottom of the container containing the liquid and the open end 15 of the tube 2 from the viewpoint of generating a sufficient amount of the micro gas bubbles in the liquid. Assuming the inner diameter of the tube 2 to be D, the distance between the bottom of the container and the open end 15 of the tube 2 is preferably set to be D/4 or more. By so setting, the liquid released from the open end 15 of the tube can be diffused into the container without undergoing a large flow passage resistance.

A portion housing the motor 6 in the gas bubble generation apparatus may be formed in a waterproof structure so that the gas bubble generation apparatus of the present invention may be entirely immersed in the liquid. In such a case, the closed end side of the tube 2 has to be made communicable with the outside gas at the predetermined ventilation resistance. To that end, a ventilation port may be disposed at a level of the liquid surface and connected to the closed end of the tube 2 through a ventilation pipe. If the gas pressure is insufficient to supply the gas into the tube, the gas may be supplied after the gas pressure has been increased.

When the micro gas bubbles are generated in the liquid by employing the present invention, various kinds of materials can be used as the liquid in addition to water. For example, seawater, oil, petroleum, alcohol, and various medical fluids are usable. Further, various kinds of gases can also be used as the gas serving as a source for the gas bubbles in addition to air. For example, $N_2$, $O_2$, $O_3$, Ar, $H_2$, $SO_x$, $NO_x$, He, hydrocarbon gas, and natural gas are usable.

When water is used as the liquid and the micro gas bubbles are generated in the water by using the gas bubble generation apparatus of the present invention, the amount of the generated micro gas bubbles differs depending on whether the water is underground water or tap water, whether the water is filtrate water obtained by filtering such water or distilled water, and whether the water is distilled water added with a surfactant, e.g., ethanol. It is generally said that the amount of the generated micro gas bubbles is minimized when the distilled water is used. By employing the present invention, however, it is confirmed even when the distilled water is used as the liquid, a large amount of the gas bubbles in excess of 1000 bubbles/mL are generated in the bubble diameter range of not less than 10 μm and less than 15 μm. In the present invention, the number of the micro gas bubbles capable of being generated in the liquid is defined on the basis of the number of the micro gas bubbles generated when the distilled water is used as the liquid.

A "light-scattering particle-in-liquid counter" (LIQILAZ-E20P made by PMS Co. in USA) using a He—Ne laser can be employed as a measuring device for measuring the diameters of gas bubbles having diameters of less than 15 μm, which are present in the liquid. By using that device, a density of gas bubbles of 2 μm or larger in the liquid can be measured while the bubble diameters are classified at a pitch of about 5 μm. In the present invention, the measurement is performed, by way of example, such that the end of a sampling hose is suspended from the top of a cylindrical water tank with a capacity of 5 liters along a water tank tubular wall to reach a level of 50 mm from the bottom of the water tank, and the water containing the gas bubbles is conveyed to an inspection section of the measuring device through the hose by a metering pump for the measurement. A sampling flow rate is 80 cc/min.

The present invention is featured in that a large amount of micro gas bubbles having diameters of less than 15 μm can be generated. More specifically, when the gas bubbles are generated in the liquid by using distilled water as the liquid and immersing at least the open end of the tube and the rotating bladed wheel in the liquid, the gas bubbles having diameters of not less than 10 μm and less than 15 μm can be obtained in the liquid discharged from the open end of the tube in number of 40 bubbles/mL or more. The number of 40 bubbles/mL or more exceeds the number of the gas bubbles which can be generated by the known methods, and can provide a satisfactory result. In addition, the gas bubbles can be generated in number of preferably 100 bubbles/mL or more and more preferably 200 bubbles/mL or more.

The present invention is further featured in that a large amount of micro gas bubbles having diameters of less than 10 μm can be generated. More specifically, when the gas bubbles are generated in the liquid by using distilled water as the liquid and immersing at least the open end of the tube and the rotating bladed wheel in the liquid, the gas bubbles having diameters of not less than 5 μm and less than 10 μm can be obtained in the liquid discharged from the open end of the tube in number of 40 bubbles/mL or more. The number of 40 bubbles/mL or more exceeds the number of the gas bubbles which can be generated by the known methods, and can provide a satisfactory result. In addition, the gas bubbles can be generated in number of preferably 100 bubbles/mL or more and more preferably 200 bubbles/mL or more.

Moreover, in the present invention, when the gas bubbles are generated in the liquid by using distilled water as the liquid and immersing at least the open end of the tube and the rotating bladed wheel in the liquid, the gas bubbles having diameters of not less than 5 μm and less than 15 μm can be obtained in the liquid discharged from the open end of the tube in number of 80 bubbles/mL or more. In addition, those gas bubbles can be generated in number of preferably 200 bubbles/mL or more and more preferably 400 bubbles/mL or more.

Further, in the present invention, it is possible to not only generate the micro gas bubbles having diameters of not less than 10 μm and less than 15 μm, diameters of not less than 5 μm and less than 10 μm, and diameters of not less than 5 μm and less than 15 μm in respective numbers described above, but also to generate fine gas bubbles having diameters of not less than 20 μm and less than 25 μm in number of 20 bubbles/mL or more at the same time.

The shape of the tube 2 in the present invention may be formed, as shown in FIG. 1, such that the inner diameter of the tube in a portion including the rotating bladed wheel 3 is set to the inner diameter D within the above-mentioned preferable range, and a portion of the tube on the side including the closed end 14 is constituted by another tube 11 having a smaller inner diameter. A portion of the tube where the tube inner diameter is changed is herein called a shoulder 12. A distance L1 from the shoulder 12 to the rotating bladed wheel 3 is usually set to be 0.25 time the blade average width d with a satisfactory result. Of course, as shown in FIG. 6(*b*), the inner diameter of the tube 2 may be set constant from the open end 15 to the closed end 14 of the tube 2.

In the gas bubble generation apparatus of the present invention, the motor 6 is disposed on the same side as the closed end 14 of the tube for the purpose of rotating the rotating bladed wheel 3. To prevent the rotating shaft 5 from causing oscillation during the rotation of the rotating bladed wheel 3, the bearing 9 of the rotating shaft 5 is preferably disposed as close as possible to the rotating bladed wheel 3. When the tube has the shoulder 12 and the tube inner diameter is changed on the side of the tube including the closed end 14 as shown in FIG. 1, the bearing 9 is preferably disposed in a portion of the tube having the smaller inner diameter at a position just near the shoulder 12. In FIG. 1, a bearing 9*b* represents the bearing 9 arranged as described above. A support member 10*b* between the bearing 9 and the tube 2 can be formed, as shown in FIG. 1(*c*), in a crossbeam structure such that the liquid is allowed to freely flow crossing the support member 10*b* in the vertical direction. Also, as shown in FIG. 1(*b*), the support member 10*a* can be formed in a planar structure such that the liquid is shut off between regions above and under the support member 10*a*. By arranging the rotating bladed wheel 3 at a position not so away from the bearing 9, oscillation of the rotating shaft 5 can be prevented. The distance between the bearing 9 and the rotating bladed wheel 3 is preferably set to be about 0.5 time the blade average width d.

Figure 8:
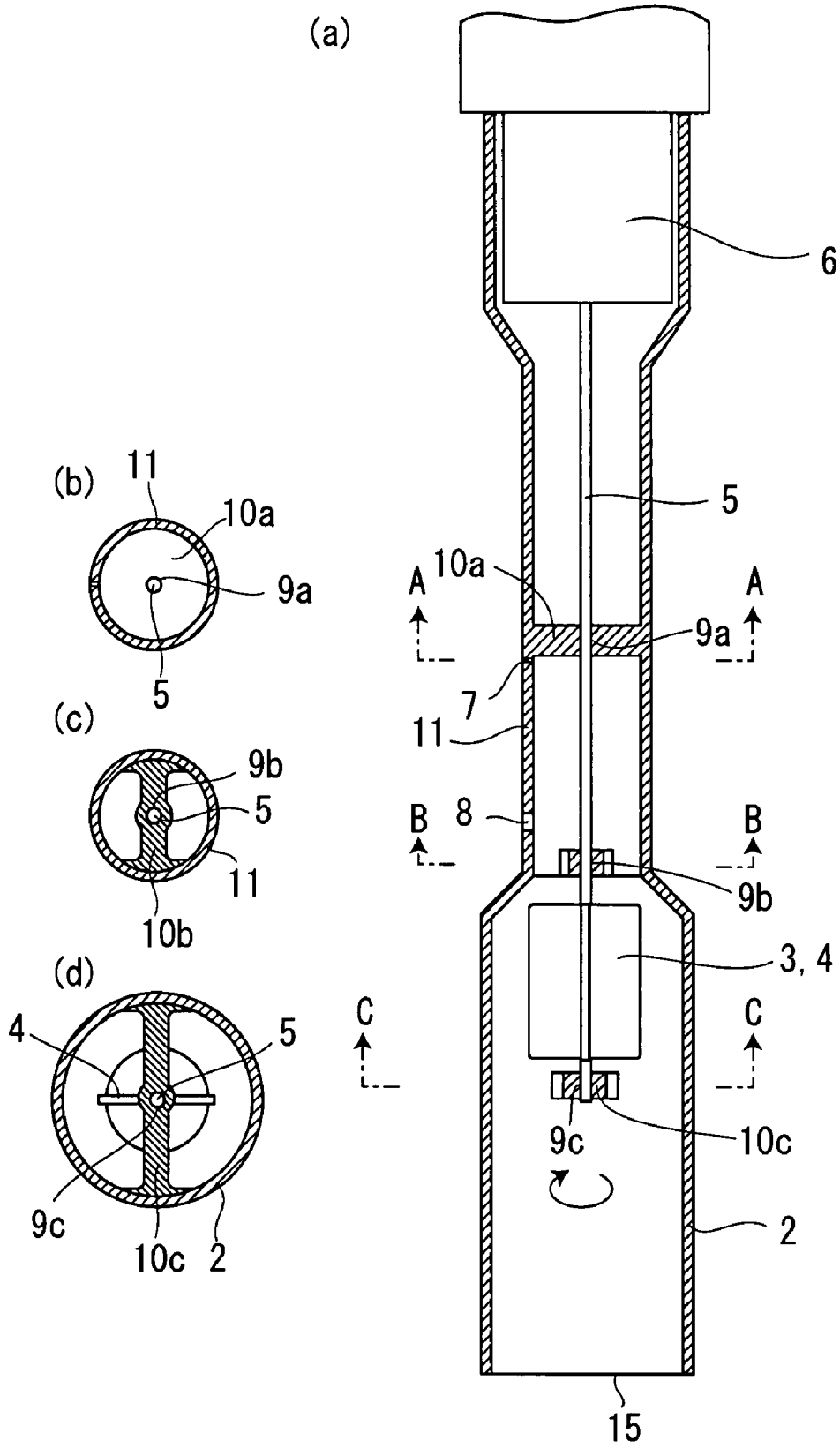

Means for supporting the rotating shaft near the rotating bladed wheel can be selected from a cantilevered manner of supporting the rotating shaft 5 only at a position between the rotating bladed wheel 3 and the motor 6 as shown in FIG. 1, and a both-end supporting manner of supporting the rotating shaft 5 at not only the above-mentioned position, but also a position on the side of the rotating bladed wheel 3 opposed to the motor 6 as shown in FIG. 8. In the case of the both-end supporting manner, as shown in FIG. 8, a support member 10*c* for supporting a bearing 9*c* has to be disposed at a position between the open end 15 of the tube 2 and the rotating bladed wheel 3, and the provision of the support member 10*c* affects the flow of the liquid through the open end 15. For that reason, the cantilevered manner can provide a more satisfactory result.

The gas bubble generation apparatus of the present invention includes, as a driving section, only the motor and the rotating bladed wheel 3 which are coupled to each other by the rotating shaft. Since the gas bubble generation apparatus requires in its body no equipment for connection to the exterior, such as a pump and a hose, the parts structure is simplified. Also, since energy for driving the motor is directly converted to the peripheral rotational speed of the blade through the rotating shaft without being subjected to another energy conversion, the gas bubble generation apparatus has a further feature that energy conversion efficiency is high. The above-described features of the present invention contribute to reducing the product cost and saving energy, and they are advantageous in promoting widespread applications to consumer-oriented and industrial fields.

EXAMPLE 1

The micro gas bubbles were generated in the liquid by using the gas bubble generation apparatus of the present invention having the structure shown in FIG. 1. Distilled water was used as the liquid for generation of the gas bubbles. For comparison, a test was also conducted on the case using distilled water containing ethanol.

The rotating bladed wheel 3 used herein had four blades 4 shown in FIGS. 2(*b*1) and 2(*b*2). Each of the blades 4 had a plate-like shape and was formed of a steel plate having a thickness of 0.8 mm. The average width d of the blades 4 was 22 mm, and the blade length L2 in the axial direction of the rotating shaft was 30 mm.

The rotating shaft 5 for rotating the rotating bladed wheel 3 was formed of a steel-made column with a diameter of 3 mm and was able to rotate the rotating bladed wheel in the range of 6000-10000 rpm when driven by the motor 6. In this example, the number of rotations was set to 10000 rpm. The peripheral speed of the rotating bladed wheel 3 was 11.5 m/sec.

A cylindrical tube was used as the tube 2, and the cylindrical tube 2 was formed at the same diameter over the region from the portion containing the rotating bladed wheel 3 to the open end 15. The inner diameter D of the cylindrical tube 2 was set to 25 mm (D/d=1.14). The distance L3 from the open end 15 of the cylindrical tube 2 to the rotating bladed wheel 3 was set to 45 mm (L3/d=2.05).

The cylindrical tube 2 had such a shape that the shoulder 13 was formed above the rotating bladed wheel 3 and a cylindrical tube portion above the shoulder 13 had an inner diameter of 20 mm, that cylindrical tube portion being called the cylindrical tube 11. The support member lob including the bearing 9*b* for the rotating shaft 5 was arranged just above the shoulder 13, and the support member 10*a* including the bearing 9*a* was arranged at a position spaced 35 mm above the support member 10*b*. The support member 10*a* serves also to form the closed end 14 of the cylindrical tube 2. The distance (L1) between the lower support member 10*b* and the upper end of the rotating bladed wheel 3 was set to 7 mm.

The ventilation hole 7 was formed in the cylindrical tube 11 at a position just near the closed end. The cylindrical tube 11 had a wall thickness of 3 mm, and an inner diameter $d_G$ of the ventilation hole 7 was set to 1.2 mm ($d_G$/d=0.055). Further, the liquid communication port 8 having a diameter of 4 mm was formed just above the support member 10*b*.

Distilled water was employed as the liquid 20 for generating the gas bubbles by using the gas bubble generation apparatus of the present invention. 5 Liters of distilled water was poured in a cylindrical water tank having a diameter of 170 mm and a height of 270 mm, and the gas bubble generation apparatus was immersed into the water from above a central area of the water surface in the water tank. An experiment was also conducted on the case using the liquid prepared by adding 5 cc of ethanol to 5 liters of distilled water. Further, an experiment was conducted on the case using filtrate water. The filtrate water was prepared by pumping up underground water and filtering the underground water with a tap-water purification unit employing activated charcoal and a hollow-fiber film filter.

When the micro gas bubbles were generated, the gas bubble generation apparatus was immersed in the liquid with the open end 15 of the cylindrical tube 2 directed downward. The position of the gas bubble generation apparatus in the vertical direction was set such that the upper end of the rotating bladed wheel 3 was located 20 mm downward from the position of the liquid surface 21.

The "light-scattering particle-in-liquid counter" (LIQ-ILAZ-E20P made by PMS Co. in USA) using a He—Ne laser was used to measure the number of the gas bubbles generated in the liquid. The water taking-in position was set to a position located at a height of 50 mm from the bottom of the water tank along the side wall of the water tank. The end of a sampling hose was suspended from the top of the water tank to reach the water taking-in position, and the liquid in the water tank was conveyed to the inspection section of the measuring device through the hose by a metering pump for measuring the number of the gas bubbles in the liquid. A sampling flow rate was 80 cc/min.

By operating the gas bubble generation apparatus immersed in the water within the water tank, the number of the gas bubbles was measured by using the above-mentioned measuring device. Diameters of the gas bubbles were divided at a pitch of 5 μm into ranges of not less than 2 μm and less than 5 μm, of not less than 5 μm and less than 10 μm, of not less than 10 μm and less than 15 μm, of not less than 15 μm and less than 20 μm, of not less than 20 μm and less than 25 μm, and so on until 50 μm. The number of the gas bubbles per range was displayed in units of bubbles/mL.

TABLE 1

| | | Numeral denotes number of gas bubbles (bubbles/mL) | | | | | | | | | | |
|---|---|---|---|---|---|---|---|---|---|---|---|---|
| | | Bubble diameter (μm) (lower limit (not less than)/upper limit (less than)) | | | | | | | | | | |
| No. | Kind of liquid | 2/5 | 5/10 | 10/15 | 15/20 | 20/25 | 25/30 | 30/35 | 35/40 | 40/45 | 45/50 | 50/55 |
| 1 | Distilled water | 630 | 1175 | 1964 | 282 | 45 | 25 | 16 | 14 | 10 | 9 | 8 |
| 2 | Distilled water | 963 | 1631 | 2374 | 295 | 119 | 117 | 113 | 99 | 82 | 62 | 47 |
| 3 | Distilled water + ethanol | 2816 | 1430 | 2579 | 460 | 104 | 38 | 21 | 15 | 13 | 10 | 7 |
| 4 | Filtrate water | 594 | 118 | 365 | 258 | 300 | 312 | 233 | 112 | 45 | 22 | 16 |

The measured results are shown in Table 1. As seen from Nos. 1 and 2 in Table 1, when the distilled water was used as the liquid, a very large amount of the gas bubbles could be generated in number beyond 1000 bubbles/mL in each of the region of not less than 5 μm and less than 10 μm and the region of not less than 10 μm and less than 15 μm. Also, even in the range of not less than 2 μm and less than 5 μm, a large amount of the micro gas bubbles beyond 500 bubbles/mL were generated.

Further, as seen from No. 3 in Table 1, when the distilled water containing ethanol was used as the liquid, the number of the micro gas bubbles was significantly increased in each of the bubble diameter ranges. The number of the micro gas bubbles exceeded 2000 bubbles/mL in each of the region of not less than 2 μm and less than 5 μm and the region of not less than 10 μm and less than 15 μm. Further, the number of the gas bubbles was significantly increased in the range of not less than 5 μm and less than 10 μm, the range of not less than 15 μm and less than 20 μm, and the range of not less than 20 μm and less than 25 μm. Even in the bubble diameter ranges beyond 25 μm, the number of the gas bubbles was also increased.

When the filtrate water was used as the liquid like No. 4, the gas bubbles were generated in larger number in the case of the filtrate water than the case of the distilled water in the bubble diameter ranges of not less than 20 μm. Particularly, in the region of not less than 30 μm and less than 35 μm, the number of the gas bubbles generated in the case of the filtrate water was increased 12 times. In the past, the distilled water was regarded as being hard to generate the micro gas bubbles. It can be, however, said that such a property of the distilled water represents the above-mentioned behavior in the bubble diameter range of not less than 20 μm.

On the other hand, in No. 4, the number of the gas bubbles equivalent to that in the case of the distilled water was realized in each of the range of not less than 2 μm and less than 5 μm and the range of not less than 15 μm and less than 20 μm.

Further, in each of the range of not less than 5 μm and less than 10 μm and the range of not less than 10 μm and less than 15 μm, the number of the gas bubbles generated in the case of the distilled water was larger than that in the case of the filtrate water.

EXAMPLE 2

Example of Present Invention

As in Example 1, the micro gas bubbles were generated in the liquid by using the gas bubble generation apparatus having the structure shown in FIG. 1. As the liquid for generation of the gas bubbles, the distilled water was used in Example 1, while filtrate water prepared by pumping up underground water and filtering the underground water was used in Example 2.

The shape of the rotating bladed wheel 3 was basically the same as that in Example 1. Each blade 4 had such a shape that, as shown in FIGS. 2(*b*1) and 2(*b*2), the holes 12 were formed in the blade 4.

The rotating shaft 5 for rotating the rotating bladed wheel 3 was, as in Example 1, formed of a steel-made column with a diameter of 3 mm and was able to rotate the rotating bladed wheel in the range of 6000-10000 rpm when driven by the motor 6. In this example, the number of rotations was set to 10000 rpm. The peripheral speed of the rotating bladed wheel 3 was 11.5 m/sec.

The cylindrical tube 2 was formed at the same diameter over the region from the portion containing the rotating bladed wheel 3 to the open end 15. The inner diameter D of the cylindrical tube 2 was selected from four values, i.e., 25, 28, 36 and 42 mm (D/d=1.14, 1.27, 1.64 and 1.91). The distance L3 from the open end 15 of the cylindrical tube 2 to the rotating bladed wheel 3 was selected from the range of 0 mm to 130 mm (L3/d=0-5.91).

The cylindrical tube 2 had such a shape that the shoulder 13 was formed above the rotating bladed wheel 3 and a cylindrical tube portion above the shoulder 13 had an inner diameter of 20 mm, that cylindrical tube portion being called the cylindrical tube 11. The support member 10*b* including the bearing 9*b* for the rotating shaft 5 was arranged just above the shoulder 13, and the support member 10*a* including the bearing 9*a* was arranged at a position spaced 35 mm above the support member 10*b*. The support member 10*a* serves also to form the closed end 14 of the cylindrical tube 2. The distance (L1) between the lower support member 10*b* and the upper end of the rotating bladed wheel 3 was set to 7 mm. Those points are the same as in Example 1.

The ventilation hole 7 was formed in the cylindrical tube 11 at a position just near the closed end. The cylindrical tube 11 had a wall thickness of 3 mm, and an inner diameter $d_G$ of the ventilation hole 7 was set to 1.2 mm ($d_G$/d=0.055). Further, the liquid communication port 8 having a diameter of 4 mm was formed just above the support member 10*b*.

Filtrate water was employed as the liquid 20 for generating the gas bubbles by using the gas bubble generation apparatus of the present invention. The filtrate water was prepared, as in Example 1, by pumping up underground water and filtering the underground water with a tap-water purification unit employing activated charcoal and a hollow-fiber film filter. 5 Liters of the filtrate water was poured in the cylindrical water tank having a diameter of 170 mm and a height of 270 mm, and the gas bubble generation apparatus was immersed into the water from above a central area of the water surface in the water tank.

When the micro gas bubbles were generated, the gas bubble generation apparatus was immersed in the liquid with the open end 15 of the cylindrical tube 2 directed downward. The position of the gas bubble generation apparatus in the vertical direction was set such that the upper end of the rotating bladed wheel 3 was located 20 mm downward from the position of the liquid surface 21.

The method of measuring the number of the gas bubbles generated in the liquid was also the same as that in Example 1. Specifically, the "light-scattering particle-in-liquid counter" (LIQILAZ-E20P made by PMS Co. in USA) using a He-Ne laser was used to measure the number of the gas bubbles generated in the liquid. The water taking-in position was set to a position located at a height of 50 mm from the bottom of the water tank along the side wall of the water tank. The end of the sampling hose was suspended from the top of the water tank to reach the water taking-in position, and the liquid in the water tank was conveyed to the inspection section of the measuring device through the hose by the metering pump for measuring the number of the gas bubbles in the liquid. A sampling flow rate was 80 cc/min.

The measured results are shown in Table 2 as indicated by Nos. 5-16.

TABLE 2

Numeral denotes number of gas bubbles (bubbles/mL)

| | Inner diameter of outer tube | L3 | Bubble diameter (μm) (lower limit (not less than)/upper limit (less than)) | | | | | | | | | | |
|---|---|---|---|---|---|---|---|---|---|---|---|---|---|
| No. | D (mm) | (mm) | 2/5 | 5/10 | 10/15 | 15/20 | 20/25 | 25/30 | 30/35 | 35/40 | 40/45 | 45/50 | 50/55 |
| 5 | 25 | 20 | 477 | 96 | 111 | 95 | 105 | 122 | 108 | 84 | 71 | 51 | 35 |
| 6 | 25 | 30 | 535 | 116 | 154 | 132 | 165 | 187 | 170 | 145 | 115 | 89 | 62 |
| 7 | 25 | 45 | 594 | 118 | 365 | 258 | 300 | 312 | 233 | 112 | 45 | 22 | 16 |
| 8 | 28 | 20 | 411 | 82 | 65 | 44 | 42 | 44 | 33 | 24 | 16 | 9 | 6 |
| 9 | 28 | 30 | 1083 | 472 | 116 | 108 | 80 | 79 | 75 | 56 | 36 | 27 | 14 |
| 10 | 28 | 40 | 403 | 101 | 77 | 50 | 46 | 46 | 40 | 24 | 16 | 8 | 4 |
| 11 | 28 | 60 | 1083 | 472 | 116 | 108 | 80 | 79 | 75 | 56 | 36 | 27 | 14 |
| 12 | 36 | 0 | 299 | 85 | 34 | 12 | 11 | 8 | 4 | 3 | 2 | 0 | 0 |
| 13 | 36 | 30 | 490 | 100 | 41 | 28 | 31 | 36 | 35 | 25 | 18 | 12 | 7 |
| 14 | 36 | 60 | 438 | 101 | 27 | 15 | 19 | 20 | 21 | 16 | 13 | 8 | 3 |
| 15 | 36 | 105 | 489 | 104 | 37 | 24 | 27 | 28 | 28 | 21 | 16 | 10 | 5 |
| 16 | 42 | 70 | 263 | 166 | 478 | 308 | 268 | 195 | 91 | 34 | 20 | 16 | 15 |

Table 3, given below, shows the measured results of comparing the case (No. 17) where the filtrate water is used as the liquid and the volume of the filtrate water was set 5 liters as in Table 2 and the case (No. 18) where a larger water tank was used and 100 liters of the filtrate water was filled in the larger water tank. Conditions of the gas bubble generation apparatus were similar to those in Table 2 except for setting D=42 mm and L3=70 mm. It is apparent that even when the liquid volume is increased to 100 liters, a sufficiently large amount of the micro gas bubbles are generated.

TABLE 3

| | | Numeral denotes number of gas bubbles (bubbles/mL) | | | | | | | | | | |
|---|---|---|---|---|---|---|---|---|---|---|---|---|
| | Liquid volume | Bubble diameter (μm) (lower limit (not less than)/upper limit (less than)) | | | | | | | | | | |
| No. | (liters) | 2/5 | 5/10 | 10/15 | 15/20 | 20/25 | 25/30 | 30/35 | 35/40 | 40/45 | 45/50 | 50/55 |
| 17 | 5 | 263 | 166 | 478 | 308 | 268 | 195 | 91 | 34 | 20 | 16 | 15 |
| 18 | 100 | 523 | 752 | 1717 | 1057 | 769 | 543 | 231 | 80 | 29 | 11 | 4 |

Comparative Example

As Comparative Example, a test was conducted using a gas bubble generation apparatus in which, as described in Patent Documents 2 and 3, a liquid and gas were agitated and mixed with each other based on vortex flow motions caused by the rotating operation of the rotating shaft, the cutting operation of the agitation bladed wheel mounted to the rotating shaft, and the collision operation between forward bubble vortex flows and reverse bubble vortex flows.

The gas bubble generation apparatus of Comparative Example is similar in its entire shape to the apparatus shown in FIG. 1 of Patent Document 2. A rotating shaft is installed within a cylindrical tube having an inner diameter D of 35 mm, and two cylindrical rotating members and four agitation bladed wheels (rotating bladed wheels) are mounted to the rotating shaft. Each of the rotating members has a diameter of 31 mm and a length of 15 mm. Each of the rotating bladed wheels has three blades, and the average width d of the blades is 31 mm. The normal direction to the face of each blade of the rotating bladed wheels forms an angle of 45° with respect to the circumferential direction of rotation of the rotating bladed wheel. Of the four rotating bladed wheels, two wheels have the blades of which surfaces facing the rotating direction are oriented upward at an angle of 45° and the other two wheels have the blades of which surfaces facing the rotating direction are oriented downward at an angle of 45°. The number of rotations of the rotating shaft is 2800 rpm.

A ventilation port is formed at the upper end of the tube, and the ventilation port has a diameter of 8 mm and a length of 12 mm. Also, a liquid communication port is formed at the upper end of the tube, and the liquid communication port is made up of four ports each having a diameter of 11 mm. A diffusion blade is arranged at the lower end of the tube for diffusing the liquid in which are generated the gas bubbles.

10 Liters of filtrate water was filled in a water tank and the gas bubbles were generated by using the gas bubble generation apparatus of Comparative Example. The measured results are shown in Table 4 as indicated by No. 19.

TABLE 4

| | | Numeral denotes number of gas bubbles (bubbles/mL) | | | | | | | | | | |
|---|---|---|---|---|---|---|---|---|---|---|---|---|
| | Gas bubble generation | Bubble diameter (μm) (lower limit (not less than)/upper limit (less than)) | | | | | | | | | | |
| No. | apparatus | 2/5 | 5/10 | 10/15 | 15/20 | 20/25 | 25/30 | 30/35 | 35/40 | 40/45 | 45/50 | 50/55 |
| 19 | Comparative Example | 254 | 54 | 25 | 9 | 8 | 9 | 6 | 6 | 4 | 2 | 2 |

Comparison of Generation of Gas Bubbles

As seen from Table 4, the micro gas bubbles of 5-10 μm and 10-15 μn were generated in predetermined numbers even when the gas bubble generation apparatus of Comparative Example was used. Comparing Comparative Example shown in Table 4 and Example of the present invention shown in Table 2, the number of the generated micro gas bubbles is apparently increased in Example of the present invention. The number of the generated micro gas bubbles of 2-5 μm is also significantly increased. It is further apparent that, in any of the ranges of not less than 15 μm and less than 50 μm, the number of the generated micro gas bubbles is increased in Example of the present invention as compared with Comparative Example.

As seen from Table 2, even when D and L3 were changed within the ranges defined in the present invention, the micro gas bubbles were satisfactorily generated at any values of D and L3.

Comparing No. 17 and No. 18 in Table 3, in the case using the gas bubble generation apparatus of the present invention, it is apparent that the gas bubbles are sufficiently satisfactorily generated even when the liquid volume is increased from 5 liters to 100 liters.

Further, the gas bubble generation test was also conducted on the case where the rotating bladed wheel 3 had the blades 4 including no holes 12, as shown in FIGS. 2(*a*1) and 2(*a*2), instead of the blades including the holes 12 as shown in FIGS. 2(*b*1) and 2(*b*2). As a result, the micro gas bubbles could be satisfactorily generated regardless of the presence or absence of the holes 12.

EXAMPLE 3 using the gas bubble generation apparatuses having the structures shown in FIGS. 7 and 1, evaluation was made on change in capability of generating the micro gas bubbles in the liquid depending on whether the partially opened sheet 16 having a large number of opening was provided or not. As in Example 2, the filtrate water prepared by filtering the pumped-up underground water was used as the liquid for generation of the gas bubbles.

The shape of the rotating bladed wheel 3 was basically the same as that in Example 1. Each blade 4 had such a shape that, as shown in FIGS. 2(*b*1) and 2(*b*2), the holes 12 were formed in the blade 4. The rotating shaft 5 for rotating the rotating bladed wheel 3 was, as in Example 1, formed of a steel-made column with a diameter of 3 mm and the number of rotations was set to 10000 rpm.

The cylindrical tube 2 was formed at the same diameter over the region from the portion containing the rotating bladed wheel 3 to the open end 15. The inner diameter D of the cylindrical tube 2 was set to 40 mm. The distance L3 from the open end 15 of the cylindrical tube 2 to the rotating bladed wheel 3 was set to 40 mm. The ventilation hole 7 was formed in the cylindrical tube 11 at a position just near the closed end. The cylindrical tube 11 had a wall thickness of 3 mm, and an inner diameter $d_G$ of the ventilation hole 7 was set to 1 mm. Further, the liquid communication port 8 having a diameter of 4 mm was formed just above the support member 10*b*.

The partially opened sheet 16 was provided at the open end 15 of the tube 2 as shown in FIG. 7. The partially opened sheet 16 was formed by braiding metal wires with a diameter of 0.5 mm into a square wire net at a pitch of 1.5 mm such that a very large number of openings of 1 mm×1 mm were formed.

The filtrate water was employed as the liquid 20 for generating the gas bubbles by using the gas bubble generation apparatus of the present invention. 2 Liters of the filtrate water was poured in a cylindrical water tank having a diameter of 130 mm and a height of 200 mm, and the gas bubble generation apparatus was immersed into the water from above a central area of the water surface in the water tank. When the micro gas bubbles were generated, the gas bubble generation apparatus was immersed in the liquid with the open end 15 of the cylindrical tube 2 directed downward. The position of the gas bubble generation apparatus in the vertical direction was set such that the upper end of the rotating bladed wheel 3 was located 20 mm downward from the position of the liquid surface 21.

The method of measuring the number of the gas bubbles generated in the liquid was also the same as that in Examples 1 and 2. Specifically, the "light-scattering particle-in-liquid counter" (LIQILAZ-E20P made by PMS Co. in USA) using a He—Ne laser was used to measure the number of the gas bubbles generated in the liquid.

The measured results are shown in Table 5 as indicated by Nos. 20 and 21. No. 20 represents the case where the partially opened sheet 16 was provided, and No. 21 represents the case where the partially opened sheet 16 was not provided.

TABLE 5

| | | Numeral denotes number of gas bubbles (bubbles/mL) | | | | | | | | | | |
|---|---|---|---|---|---|---|---|---|---|---|---|---|
| | Provision of partially | Bubble diameter (μm) (lower limit (not less than)/upper limit (less than)) | | | | | | | | | | |
| No. | opened sheet | 2/5 | 5/10 | 10/15 | 15/20 | 20/25 | 25/30 | 30/35 | 35/40 | 40/45 | 45/50 | 50/55 |
| 20 | Provided | 1180 | 223 | 136 | 94 | 83 | 82 | 61 | 43 | 25 | 11 | 5 |
| 21 | Not provided | 1137 | 134 | 57 | 54 | 48 | 53 | 41 | 29 | 18 | 9 | 4 |

As seen from Table 5, the gas bubbles having diameters of 10-15 μm were generated in number of 56 bubbles/mL in No. 21 not provided with the partially opened sheet, while those gas bubbles were generated in number of 135 bubbles/mL, i.e., 2.4 times, in No. 20 provided with the partially opened sheet. Also, from the same experiment, it was confirmed that the gas bubbles having diameters of 15-20 μm were generated in number of 54 bubbles/mL when the partially opened sheet was not provided, while those gas bubbles were generated in number of 94 bubbles/mL, i.e., 1.7 times, when the partially opened sheet was provided.

EXAMPLE 4

The gas bubbles were generated by using the same gas bubble generation apparatus as that in Example 1 and the same method as that in Example 1 except for the following points. As the first one of the different points from Example 1, only filtrate water was used as the liquid. The filtrate water used herein was prepared under the same conditions as those in Example 1. Evaluation was made under respective different conditions shown as Nos. 22-27 in Table 6, given below.

In No. 22, the number of rotations of the rotating bladed wheel was set to 5050 rpm. In this case, the peripheral speed of the rotating bladed wheel 3 was 5.8 m/sec. In Nos. 23-26, the inner diameter of the ventilation port was set to 1 mm, 3.3 mm, 5 mm and 7 mm, respectively. In No. 27, the number of the blades 4 of the rotating bladed wheel 3 was set to two. In Nos. 22-27, the conditions other than the thus-changed points were similarly set to those in Example 1.

The measured results are shown in Table 6. As seen from Table 6, in any of Nos. 22-27, the gas bubbles could be satisfactorily generated. Also, as seen from the results of Nos. 23-26, the number of the generated micro gas bubbles could be increased as the diameter of the ventilation port was reduced to increase the ventilation resistance.

TABLE 6

Numeral denotes number of gas bubbles (bubbles/mL)

| No. | Difference from Example 1 | Bubble diameter (μm) (lower limit (not less than)/upper limit (less than)) 2/5 | 5/10 | 10/15 | 15/20 | 20/25 | 25/30 | 30/35 | 35/40 | 40/45 | 45/50 | 50/55 |
|---|---|---|---|---|---|---|---|---|---|---|---|---|
| 22 | Number of rotations = 5050 rpm | 724 | 113 | 46 | 26 | 19 | 22 | 15 | 8 | 4 | 2 | 0 |
| 23 | Diameter of ventilation port = 1 mm | 831 | 141 | 58 | 32 | 24 | 28 | 19 | 10 | 5 | 2 | 0 |
| 24 | Diameter of ventilation port = 3.3 mm | 789 | 123 | 51 | 34 | 29 | 31 | 20 | 12 | 6 | 1 | 0 |
| 25 | Diameter of ventilation port = 5 mm | 403 | 50 | 30 | 26 | 18 | 17 | 12 | 5 | 3 | 1 | 0 |
| 26 | Diameter of ventilation port = 7 mm | 385 | 52 | 30 | 24 | 18 | 18 | 12 | 5 | 3 | 0 | 0 |
| 27 | Number of blades = 2 blades | 411 | 64 | 37 | 28 | 11 | 20 | 16 | 8 | 4 | 3 | 0 |

Further, the gas bubbles were generated by using the same gas bubble generation apparatus as that in Example 1 and the same method as that in Example 1 except for the following points. 2 Liters of distilled water was used as the liquid, and the evaluation for the generation of the gas bubbles was made in a stage after the lapse of 3 minutes from starting the operation of the gas bubble generation apparatus. The container size was the same as that in Example 3. The measured results are shown in Table 7. No. 27 represents the case where the partially opened sheet was not provided. No. 28 represents the case where a punched metal having an infinite number of hexagonal openings with opposite sides each having a length of 6 mm was used as the partially opened sheet.

TABLE 7

Numeral denotes number of gas bubbles (bubbles/mL)

| No. | Provision of partially opened sheet | Bubble diameter (μm) (lower limit (not less than)/upper limit (less than)) 2/5 | 5/10 | 10/15 | 15/20 | 20/25 | 25/30 | 30/35 | 35/40 | 40/45 | 45/50 | 50/55 |
|---|---|---|---|---|---|---|---|---|---|---|---|---|
| 27 | Not provided | 417 | 40 | 113 | 116 | 97 | 120 | 127 | 110 | 80 | 57 | 32 |
| 28 | Provided | 679 | 179 | 89 | 66 | 74 | 52 | 33 | 16 | 7 | 3 | 3 |

The data obtained in Example 1 using the distilled water shows that the gas bubbles are generated in number beyond 1000 bubbles/mL in each of the range of not less than 5 μm and less than 10 μm and the range of not less than 10 μm and less than 15 μm. On the other hand, the data listed in Table 7 shows that the gas bubbles are generated in number of 40 bubbles/mL in the range of not less than 5 μm and less than 10 μm and in number of 113 bubbles/mL in the range of not less than 10 μm and less than 15 μm. Those data differ from each other in that the data obtained in Example 1 is measured after intermittently operating the gas bubble generation apparatus at intervals of a period of about 5 minutes, while the data obtained in Example 4 and shown in Table 7 is measured after 3 minutes from starting the operation. From those data, the following points are understood. By operating the gas bubble generation apparatus of the present invention for a long time, e.g., 20 minutes or more, or by intermittently operating it at intervals of a period of about 5 minutes, the gas bubbles can be generated in number beyond 1000 bubbles/mL in each of the range of not less than 5 μm and less than 10 μm and the range of not less than 10 μm and less than 15 μm. Further, even by operating the gas bubble generation apparatus for a short time, the gas bubbles are generated in number of 40 bubbles/mL or more in each of those ranges.

INDUSTRIAL APPLICABILITY

The known methods of generating the fine gas bubbles are able to generate a large amount of fine gas bubbles having diameters of 10-20 μm in the liquid, and to efficiently dissolve gas, such as air, in a liquid, such as water. The present invention can also provide the similar advantages.

In addition, the method of generating the fine gas bubbles according to the present invention is able to generate a large amount of micro gas bubbles having diameters of less than 15 μm in the liquid. Therefore, the pressure generated in the gas bubbles due to surface tension is further increased, thus enabling the present invention to be applied to produce gas hydrates based on stronger self-compression of the micro gas bubbles, to promote cultivation of fish and shells, and to utilize electric characteristics of the micro gas bubbles. Consequently, the industrial applicability of the present invention is expected in a very wide range of fields with high practical value.

The invention claimed is:

1. A method of generating micro gas bubbles in a liquid, the method comprising the steps of preparing a tube having a closed end at one end and an open end at the other end and a rotating bladed wheel installed in said tube and rotating coaxially or substantially coaxially with said tube, said rotating bladed wheel having one or more blades, a normal line to each of faces of said blades falling within ±15° from a location parallel to a plane extending perpendicularly to an axis of a rotating shaft of said rotating bladed wheel at any position on the blade face, immersing at least the open end of said tube and said rotating bladed wheel in the liquid, and rotating said rotating bladed wheel at 5.8 m/sec or higher as a speed of an outermost peripheral portion of said blade in the rotating direction when said rotating bladed wheel is rotated.

2. The method of generating micro gas bubbles in a liquid according to claim 1, wherein when an average width of said blades is defined to be twice a width from a center of said rotating shaft to an outer periphery of each blade in the radial direction of rotation, ventilation resistance between the interior of said tube on the side near the closed end of said tube and outside gas is equal to or larger than that of a ventilation port having an inner diameter of 0.36 time the average width of said blades and a length of 3 mm.

3. The method of generating micro gas bubbles in a liquid according to claim l, wherein when distilled water is used as the liquid, the number of gas bubbles having diameters of not less than 10 μm and less than 15 μm, which are contained in the liquid discharged from the open end of said tube, is 40 bubbles/mL or more.

4. A gas bubble generation apparatus for generating micro gas bubbles in a liquid, the apparatus comprising a tube having a closed end at one end and an open end at the other end, and a rotating bladed wheel installed in said tube and rotating coaxially or substantially coaxially with said tube, said rotating bladed wheel having one or more blades a normal line to each of faces of said blades falling within ±15° from a location parallel to a plane extending perpendicularly to an axis of a rotating shaft of said rotating bladed wheel at any position on the blade face, said rotating bladed wheel being able to rotate at 5.8 m/sec or higher as a speed of an outermost peripheral portion of said blade in the rotating direction when said rotating bladed wheel is rotated, when the open end of said tube and said rotating bladed wheel are immersed in the liquid on condition that an average width of said blades is defined to be twice a width from a center of said rotating shaft to an outer periphery of each blade in the radial direction of rotation.

5. The gas bubble generation apparatus for generating micro gas bubbles in a liquid according to claim 4, wherein ventilation resistance between the interior of said tube on the side near the closed end of said tube and outside gas is equal to or larger than that of a ventilation port having an inner diameter of 0.36 time the average width of said blades and a length of 3 mm.

6. The gas bubble generation apparatus for generating micro gas bubbles in a liquid according to claim 4, wherein a distance from the open end of said tube to said rotating bladed wheel is 0.5 or more time the average width of said blades.

7. The gas bubble generation apparatus for generating micro gas bubbles in a liquid according to claim 4, wherein an inner diameter of said tube is within a range of 1.1-2.5 times the average width of said blades.

8. The gas bubble generation apparatus for generating micro gas bubbles in a liquid according to claim 4, wherein a length of said blade in the axial direction of said rotating shaft is 0.2 or more time the average width of said blades.

9. The gas bubble generation apparatus for generating micro gas bubbles in a liquid according to claim 4, wherein said blade is formed of a plate having one or more holes formed in the face thereof.

10. The gas bubble generation apparatus for generating micro gas bubbles according to claim 4, wherein a partially opened sheet having a large number of openings is provided at the open end of said tube or between the open end of said tube and said rotating bladed wheel.

11. The gas bubble generation apparatus for generating micro gas bubbles in a liquid according to claim 4, wherein when distilled water is used as the liquid and the gas bubbles are generated by immersing at least the open end of said tube and said rotating bladed wheel in the liquid, the number of gas bubbles having diameters of not less than 10 μm and less than 15 μm, which are contained in the liquid discharged from the open end of said tube, is 40 bubbles/mL or more.

* * * * *